US009267650B2

(12) United States Patent
Simon et al.

(10) Patent No.: US 9,267,650 B2
(45) Date of Patent: Feb. 23, 2016

(54) LENS FOR AN LED-BASED LIGHT

(71) Applicant: iLumisys, Inc., Troy, MI (US)

(72) Inventors: David L. Simon, Grosse Pointe Woods, MI (US); James M. Amrine, Jr., Ann Arbor, MI (US)

(73) Assignee: ILUMISYS, INC., Troy, MI (US)

( * ) Notice: Subject to any disclaimer, the term of this patent is extended or adjusted under 35 U.S.C. 154(b) by 62 days.

(21) Appl. No.: 14/208,546

(22) Filed: Mar. 13, 2014

(65) Prior Publication Data

US 2015/0098228 A1 Apr. 9, 2015

Related U.S. Application Data

(60) Provisional application No. 61/888,742, filed on Oct. 9, 2013.

(51) Int. Cl.
*F21K 99/00* (2010.01)
*F21Y 103/00* (2006.01)

(52) U.S. Cl.
CPC ... *F21K 9/17* (2013.01); *F21K 9/50* (2013.01); *F21Y 2103/003* (2013.01)

(58) Field of Classification Search
CPC ..... F21K 9/175; F21K 9/10; F21K 9/1375; F21K 9/30; F21K 9/50; F21Y 2101/02; F21Y 2103/003; F21Y 2105/001; B29L 2011/00; H02J 9/065
USPC ..... 362/217.01, 219, 222, 223, 217.02, 362/217.04, 217.08, 217.13, 240, 244, 246, 362/249.01, 249.02, 260, 326, 329, 800
See application file for complete search history.

(56) References Cited

U.S. PATENT DOCUMENTS

D54,511 S 2/1920 Owen
D58,105 S 6/1921 Poritz
D79,814 S 11/1929 Hoch
(Continued)

FOREIGN PATENT DOCUMENTS

CN 1584388 A 2/2005
CN 2766345 Y 3/2006
(Continued)

OTHER PUBLICATIONS

Best Practice Guide—Commercial Office Buildings—Central HVAC System. [online], [Retrieved on Jan. 17, 2008] Retrieved from FlexYour Power Organization web page using Internet <URL: http://www.fypower.org/bpg/module.html?b=offices&m+Central HVAC Systems&s=Contr...>.
(Continued)

*Primary Examiner* — Hargobind S Sawhney
(74) *Attorney, Agent, or Firm* — Young, Basile, Hanlon & MacFarlane, P.C.

(57) ABSTRACT

An LED-based replacement light for a fluorescent light includes a plurality of LEDs and an elongate housing for the LEDs. The housing is defined at least in part by a lens and has a cross sectional profile that partially falls along a cross sectional profile of a fluorescent light that the LED-based light is designed to replace. In addition, at least a portion of the lens extends beyond the cross sectional profile of the fluorescent light. The LED-based light also includes at least one connector arranged at an end of the housing that is configured for engagement with a socket of a fluorescent light fixture.

18 Claims, 4 Drawing Sheets

(56) References Cited

U.S. PATENT DOCUMENTS

| | | | |
|---|---|---|---|
| D80,419 | S | 1/1930 | Kramer |
| D84,763 | S | 7/1931 | Stange |
| D119,797 | S | 4/1940 | Winkler et al. |
| D125,312 | S | 2/1941 | Logan |
| 2,826,679 | A | 3/1958 | Rosenberg |
| 2,909,097 | A | 10/1959 | Alden et al. |
| 3,178,622 | A | 4/1965 | Paul et al. |
| 3,272,977 | A | 9/1966 | Holmes |
| 3,318,185 | A | 5/1967 | Kott |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,739,336 | A | 6/1973 | Burland |
| 3,746,918 | A | 7/1973 | Drucker et al. |
| 3,818,216 | A | 6/1974 | Larraburu |
| 3,821,590 | A | 6/1974 | Kosman et al. |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,969,720 | A | 7/1976 | Nishino |
| 3,974,637 | A | 8/1976 | Bergey et al. |
| 3,993,386 | A | 11/1976 | Rowe |
| 4,001,571 | A | 1/1977 | Martin |
| 4,009,394 | A | 2/1977 | Mierzwinski |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,257,672 | A | 3/1981 | Balliet |
| 4,261,029 | A | 4/1981 | Mousset |
| 4,262,255 | A | 4/1981 | Kokei et al. |
| 4,271,408 | A | 6/1981 | Teshima et al. |
| 4,271,458 | A | 6/1981 | George, Jr. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,344,117 | A | 8/1982 | Niccum |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,521,835 | A | 6/1985 | Meggs et al. |
| 4,531,114 | A | 7/1985 | Topol et al. |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,650,971 | A | 3/1987 | Manecci et al. |
| 4,656,398 | A | 4/1987 | Michael et al. |
| 4,661,890 | A | 4/1987 | Watanabe et al. |
| 4,668,895 | A | 5/1987 | Schneiter |
| 4,669,033 | A | 5/1987 | Lee |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,727,457 | A | 2/1988 | Thillays |
| 4,739,454 | A | 4/1988 | Federgreen |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,765,708 | A | 8/1988 | Becker et al. |
| 4,767,172 | A | 8/1988 | Hubble, III et al. |
| 4,771,274 | A | 9/1988 | Havel |
| 4,780,621 | A | 10/1988 | Bartleucci et al. |
| 4,794,373 | A | 12/1988 | Harrison |
| 4,794,383 | A | 12/1988 | Havel |
| 4,801,928 | A | 1/1989 | Minter |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,847,536 | A | 7/1989 | Lowe et al. |
| 4,851,972 | A | 7/1989 | Altman |
| 4,854,701 | A | 8/1989 | Noll et al. |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,904,988 | A | 2/1990 | Nesbit et al. |
| 4,912,371 | A | 3/1990 | Hamilton |
| 4,920,459 | A | 4/1990 | Rothwell et al. |
| 4,922,154 | A | 5/1990 | Cacoub |
| 4,929,936 | A | 5/1990 | Friedman et al. |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,977,351 | A | 12/1990 | Bavaro et al. |
| 4,979,081 | A | 12/1990 | Leach et al. |
| 4,979,180 | A | 12/1990 | Muncheryan |
| 4,980,806 | A | 12/1990 | Taylor et al. |
| 4,991,070 | A | 2/1991 | Stob |
| 4,992,704 | A | 2/1991 | Stinson |
| 5,001,609 | A | 3/1991 | Gardner et al. |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |
| 5,103,382 | A | 4/1992 | Kondo et al. |
| 5,122,733 | A | 6/1992 | Havel |

(56) References Cited

U.S. PATENT DOCUMENTS 5,126,634 A 6/1992 Johnson
5,128,595 A 7/1992 Hara
5,130,761 A 7/1992 Tanaka
5,130,909 A 7/1992 Gross
5,134,387 A 7/1992 Smith et al.
5,136,483 A 8/1992 Schoniger et al.
5,140,220 A 8/1992 Hasegawa
5,142,199 A 8/1992 Elwell
5,151,679 A 9/1992 Dimmick
5,154,641 A 10/1992 McLaughlin
5,161,879 A 11/1992 McDermott
5,161,882 A 11/1992 Garrett
5,164,715 A 11/1992 Kashiwabara et al.
5,184,114 A 2/1993 Brown
5,194,854 A 3/1993 Havel
5,198,756 A 3/1993 Jenkins et al.
5,209,560 A 5/1993 Taylor et al.
5,220,250 A 6/1993 Szuba
5,225,765 A 7/1993 Callahan et al.
5,226,723 A 7/1993 Chen
5,254,910 A 10/1993 Yang
5,256,948 A 10/1993 Boldin et al.
5,268,828 A 12/1993 Miura
5,278,542 A 1/1994 Smith et al.
5,282,121 A 1/1994 Bornhorst et al.
5,283,517 A 2/1994 Havel
5,287,352 A 2/1994 Jackson et al.
5,294,865 A 3/1994 Haraden
5,298,871 A 3/1994 Shimohara
5,301,090 A 4/1994 Hed
5,303,124 A 4/1994 Wrobel
5,307,295 A 4/1994 Taylor et al.
5,321,593 A 6/1994 Moates
5,323,226 A 6/1994 Schreder
5,329,431 A 7/1994 Taylor et al.
5,344,068 A 9/1994 Haessig
5,350,977 A 9/1994 Hamamoto et al.
5,357,170 A 10/1994 Luchaco et al.
5,365,411 A 11/1994 Rycroft et al.
5,371,618 A 12/1994 Tai et al.
5,374,876 A 12/1994 Horibata et al.
5,375,043 A 12/1994 Tokunaga
D354,360 S 1/1995 Murata
5,381,074 A 1/1995 Rudzewicz et al.
5,388,357 A 2/1995 Malita
5,402,702 A 4/1995 Hata
5,404,094 A 4/1995 Green et al.
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,473,522 A 12/1995 Kriz et al.
5,475,300 A 12/1995 Havel
5,481,441 A 1/1996 Stevens
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,539,628 A 7/1996 Seib
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,639,158 A 6/1997 Sato
5,640,061 A 6/1997 Bornhorst et al.
5,640,141 A 6/1997 Myllymaki
5,640,792 A 6/1997 O'Shea et al.
5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,684,523 A 11/1997 Satoh et al.
5,688,042 A 11/1997 Madadi et al.
5,690,417 A 11/1997 Choate et al.
5,697,695 A 12/1997 Lin et al.
5,699,243 A 12/1997 Eckel et al.
5,701,058 A 12/1997 Roth
5,712,650 A 1/1998 Barlow
5,713,655 A 2/1998 Blackman
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,831,522 A 11/1998 Weed et al.
5,836,676 A 11/1998 Ando et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,870,233 A 2/1999 Benz et al.
5,890,794 A 4/1999 Abtahi et al.
5,893,633 A 4/1999 Saito et al.
5,896,010 A 4/1999 Mikolajczak et al.
5,904,415 A 5/1999 Robertson et al.

(56) References Cited

U.S. PATENT DOCUMENTS 5,907,742 A 5/1999 Johnson et al.
5,909,378 A 6/1999 De Milleville
5,912,653 A 6/1999 Fitch
5,917,287 A 6/1999 Haederle et al.
5,917,534 A 6/1999 Rajeswaran
5,921,660 A 7/1999 Yu
5,924,784 A 7/1999 Chliwnyj et al.
5,927,845 A 7/1999 Gustafson et al.
5,934,792 A 8/1999 Camarota
5,936,599 A 8/1999 Reymond
5,943,802 A 8/1999 Tijanic
5,946,209 A 8/1999 Eckel et al.
5,949,347 A 9/1999 Wu
5,951,145 A 9/1999 Iwasaki et al.
5,952,680 A 9/1999 Strite
5,959,547 A 9/1999 Tubel et al.
5,961,072 A 10/1999 Bodle
5,962,989 A 10/1999 Baker
5,962,992 A 10/1999 Huang et al.
5,963,185 A 10/1999 Havel
5,966,069 A 10/1999 Zmurk et al.
5,974,553 A 10/1999 Gandar
5,980,064 A 11/1999 Metroyanis
5,998,925 A 12/1999 Shimizu et al.
5,998,928 A 12/1999 Hipp
6,000,807 A 12/1999 Moreland
6,007,209 A 12/1999 Pelka
6,008,783 A 12/1999 Kitagawa et al.
6,010,228 A 1/2000 Blackman et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
6,031,958 A 2/2000 McGaffigan
6,036,335 A 3/2000 Openiano
6,036,336 A 3/2000 Wu
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,074,074 A 6/2000 Marcus
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,115,184 A 9/2000 Hubble, III et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,135,620 A 10/2000 Marsh
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
D437,947 S 2/2001 Huang
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,234,645 B1 5/2001 Börner et al.
6,238,075 B1 5/2001 Dealey, Jr. et al.
6,240,665 B1 6/2001 Brown et al.
6,241,359 B1 6/2001 Lin
6,249,221 B1 6/2001 Reed
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,315,429 B1 11/2001 Grandolfo
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,362,578 B1 3/2002 Swanson et al.
6,369,525 B1 4/2002 Chang et al.
6,371,637 B1 4/2002 Atchinson et al.
6,373,733 B1 4/2002 Wu et al.
6,379,022 B1 4/2002 Amerson et al.
6,380,865 B1 4/2002 Pederson
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
6,396,216 B1 5/2002 Noone et al.
D458,395 S 6/2002 Piepgras et al.
6,400,096 B1 6/2002 Wells et al.
6,404,131 B1 6/2002 Kawano et al.
6,411,022 B1 6/2002 Machida
6,411,045 B1 6/2002 Nerone
6,422,716 B2 7/2002 Henrici et al.
6,428,189 B1 8/2002 Hochstein
6,429,604 B1 8/2002 Chang
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,464,373 B1 10/2002 Petrick
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,511,204 B2 1/2003 Emmel et al.
6,517,218 B2 2/2003 Hochstein
6,521,879 B1 2/2003 Rand et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,540,381 B1 4/2003 Douglass, II
6,541,800 B2 4/2003 Barnett et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.

(56) References Cited

U.S. PATENT DOCUMENTS

| | | | |
|---|---|---|---|
| 6,577,512 | B2 | 6/2003 | Tripathi et al. |
| 6,577,794 | B1 | 6/2003 | Currie et al. |
| 6,578,979 | B2 | 6/2003 | Truttmann-Battig |
| 6,582,103 | B1 | 6/2003 | Popovich et al. |
| 6,583,550 | B2 | 6/2003 | Iwasa et al. |
| 6,583,573 | B2 | 6/2003 | Bierman |
| D477,093 | S | 7/2003 | Moriyama et al. |
| 6,585,393 | B1 | 7/2003 | Brandes et al. |
| 6,586,890 | B2 | 7/2003 | Min et al. |
| 6,590,343 | B2 | 7/2003 | Pederson |
| 6,592,238 | B2 | 7/2003 | Cleaver et al. |
| 6,594,369 | B1 | 7/2003 | Une |
| 6,596,977 | B2 | 7/2003 | Muthu et al. |
| 6,598,996 | B1 | 7/2003 | Lodhie |
| 6,608,453 | B2 | 8/2003 | Morgan et al. |
| 6,608,614 | B1 | 8/2003 | Johnson |
| 6,609,804 | B2 | 8/2003 | Nolan et al. |
| 6,609,813 | B1 | 8/2003 | Showers et al. |
| 6,612,712 | B2 | 9/2003 | Nepil |
| 6,612,717 | B2 | 9/2003 | Yen |
| 6,612,729 | B1 | 9/2003 | Hoffman |
| 6,621,222 | B1 | 9/2003 | Hong |
| 6,623,151 | B2 | 9/2003 | Pederson |
| 6,624,597 | B2 | 9/2003 | Dowling et al. |
| D481,484 | S | 10/2003 | Cuevas et al. |
| 6,634,770 | B2 | 10/2003 | Cao |
| 6,634,779 | B2 | 10/2003 | Reed |
| 6,636,003 | B2 | 10/2003 | Rahm et al. |
| 6,639,349 | B1 | 10/2003 | Bahadur |
| 6,641,284 | B2 | 11/2003 | Stopa et al. |
| 6,652,117 | B2 | 11/2003 | Tsai |
| 6,659,622 | B2 | 12/2003 | Katogi et al. |
| 6,660,935 | B2 | 12/2003 | Southard et al. |
| 6,666,689 | B1 | 12/2003 | Savage, Jr. |
| 6,667,623 | B2 | 12/2003 | Bourgault et al. |
| 6,674,096 | B2 | 1/2004 | Sommers |
| 6,676,284 | B1 | 1/2004 | Wynne Willson |
| 6,679,621 | B2 | 1/2004 | West et al. |
| 6,681,154 | B2 | 1/2004 | Nierlich et al. |
| 6,682,205 | B2 | 1/2004 | Lin |
| 6,683,419 | B2 | 1/2004 | Kriparos |
| 6,700,136 | B2 | 3/2004 | Guida |
| 6,712,486 | B1 | 3/2004 | Popovich et al. |
| 6,717,376 | B2 | 4/2004 | Lys et al. |
| 6,717,526 | B2 | 4/2004 | Martineau et al. |
| 6,720,745 | B2 | 4/2004 | Lys et al. |
| 6,726,348 | B2 | 4/2004 | Gloisten |
| 6,736,525 | B2 | 5/2004 | Chin |
| 6,741,324 | B1 | 5/2004 | Kim |
| D491,678 | S | 6/2004 | Piepgras |
| D492,042 | S | 6/2004 | Piepgras |
| 6,744,223 | B2 | 6/2004 | Laflamme et al. |
| 6,748,299 | B1 | 6/2004 | Motoyama |
| 6,762,562 | B2 | 7/2004 | Leong |
| 6,768,047 | B2 | 7/2004 | Chang et al. |
| 6,774,584 | B2 | 8/2004 | Lys et al. |
| 6,777,891 | B2 | 8/2004 | Lys et al. |
| 6,781,329 | B2 | 8/2004 | Mueller et al. |
| 6,787,999 | B2 | 9/2004 | Stimac et al. |
| 6,788,000 | B2 | 9/2004 | Appelberg et al. |
| 6,788,011 | B2 | 9/2004 | Mueller et al. |
| 6,791,840 | B2 | 9/2004 | Chun |
| 6,796,680 | B1 | 9/2004 | Showers et al. |
| 6,799,864 | B2 | 10/2004 | Bohler et al. |
| 6,801,003 | B2 | 10/2004 | Schanberger et al. |
| 6,803,732 | B2 | 10/2004 | Kraus et al. |
| 6,806,659 | B1 | 10/2004 | Mueller et al. |
| 6,814,470 | B2 | 11/2004 | Rizkin et al. |
| 6,814,478 | B2 | 11/2004 | Menke |
| 6,815,724 | B2 | 11/2004 | Dry |
| 6,846,094 | B2 | 1/2005 | Luk |
| 6,851,816 | B2 | 2/2005 | Wu et al. |
| 6,851,832 | B2 | 2/2005 | Tieszen |
| 6,853,150 | B2 | 2/2005 | Clauberg et al. |
| 6,853,151 | B2 | 2/2005 | Leong et al. |
| 6,853,563 | B1 | 2/2005 | Yang et al. |
| 6,857,924 | B2 | 2/2005 | Fu et al. |
| 6,860,628 | B2 | 3/2005 | Robertson et al. |
| 6,866,401 | B2 | 3/2005 | Sommers et al. |
| 6,869,204 | B2 | 3/2005 | Morgan et al. |
| 6,871,981 | B2 | 3/2005 | Alexanderson et al. |
| 6,874,924 | B1 | 4/2005 | Hulse et al. |
| 6,879,883 | B1 | 4/2005 | Motoyama |
| 6,882,111 | B2 | 4/2005 | Kan et al. |
| 6,883,929 | B2 | 4/2005 | Dowling |
| 6,883,934 | B2 | 4/2005 | Kawakami et al. |
| 6,888,322 | B2 | 5/2005 | Dowling et al. |
| 6,897,624 | B2 | 5/2005 | Lys et al. |
| D506,274 | S | 6/2005 | Moriyama et al. |
| 6,909,239 | B2 | 6/2005 | Gauna |
| 6,909,921 | B1 | 6/2005 | Bilger |
| 6,918,680 | B2 | 7/2005 | Seeberger |
| 6,921,181 | B2 | 7/2005 | Yen |
| 6,926,419 | B2 | 8/2005 | An |
| 6,936,968 | B2 | 8/2005 | Cross et al. |
| 6,936,978 | B2 | 8/2005 | Morgan et al. |
| 6,940,230 | B2 | 9/2005 | Myron et al. |
| 6,948,829 | B2 | 9/2005 | Verdes et al. |
| 6,953,261 | B1 | 10/2005 | Jiao et al. |
| 6,957,905 | B1 | 10/2005 | Pritchard et al. |
| 6,963,175 | B2 | 11/2005 | Archenhold et al. |
| 6,964,501 | B2 | 11/2005 | Ryan |
| 6,965,197 | B2 | 11/2005 | Tyan et al. |
| 6,965,205 | B2 | 11/2005 | Piepgras et al. |
| 6,967,448 | B2 | 11/2005 | Morgan et al. |
| 6,969,179 | B2 | 11/2005 | Sloan et al. |
| 6,969,186 | B2 | 11/2005 | Sonderegger et al. |
| 6,969,954 | B2 | 11/2005 | Lys |
| 6,975,079 | B2 | 12/2005 | Lys et al. |
| 6,979,097 | B2 | 12/2005 | Elam et al. |
| 6,982,518 | B2 | 1/2006 | Chou et al. |
| 6,995,681 | B2 | 2/2006 | Pederson |
| 6,997,576 | B1 | 2/2006 | Lodhie et al. |
| 6,999,318 | B2 | 2/2006 | Newby |
| 7,004,603 | B2 | 2/2006 | Knight |
| D518,218 | S | 3/2006 | Roberge et al. |
| 7,008,079 | B2 | 3/2006 | Smith |
| 7,014,336 | B1 | 3/2006 | Ducharme et al. |
| 7,015,650 | B2 | 3/2006 | McGrath |
| 7,018,063 | B2 | 3/2006 | Michael et al. |
| 7,018,074 | B2 | 3/2006 | Raby et al. |
| 7,021,799 | B2 | 4/2006 | Mizuyoshi |
| 7,021,809 | B2 | 4/2006 | Iwasa et al. |
| 7,024,256 | B2 | 4/2006 | Krzyzanowski et al. |
| 7,029,145 | B2 | 4/2006 | Frederick |
| 7,031,920 | B2 | 4/2006 | Dowling et al. |
| 7,033,036 | B2 | 4/2006 | Pederson |
| 7,038,398 | B1 | 5/2006 | Lys et al. |
| 7,038,399 | B2 | 5/2006 | Lys et al. |
| 7,042,172 | B2 | 5/2006 | Dowling et al. |
| 7,048,423 | B2 | 5/2006 | Stepanenko et al. |
| 7,049,761 | B2 | 5/2006 | Timmermans et al. |
| 7,052,171 | B1 | 5/2006 | Lefebvre et al. |
| 7,053,557 | B2 | 5/2006 | Cross et al. |
| 7,064,498 | B2 | 6/2006 | Dowling et al. |
| 7,064,674 | B2 | 6/2006 | Pederson |
| 7,067,992 | B2 | 6/2006 | Leong et al. |
| 7,077,978 | B2 | 7/2006 | Setlur et al. |
| 7,080,927 | B2 | 7/2006 | Feuerborn et al. |
| 7,086,747 | B2 | 8/2006 | Nielson et al. |
| 7,088,014 | B2 | 8/2006 | Nierlich et al. |
| 7,088,904 | B2 | 8/2006 | Ryan, Jr. |
| 7,102,902 | B1 | 9/2006 | Brown et al. |
| 7,113,541 | B1 | 9/2006 | Lys et al. |
| 7,114,830 | B2 | 10/2006 | Robertson et al. |
| 7,114,834 | B2 | 10/2006 | Rivas et al. |
| 7,118,262 | B2 | 10/2006 | Negley |
| 7,119,503 | B2 | 10/2006 | Kemper |
| 7,120,560 | B2 | 10/2006 | Williams et al. |
| 7,121,679 | B2 | 10/2006 | Fujimoto |
| 7,122,976 | B1 | 10/2006 | Null et al. |
| 7,128,442 | B2 | 10/2006 | Lee et al. |
| 7,128,454 | B2 | 10/2006 | Kim et al. |
| D532,532 | S | 11/2006 | Maxik |

(56) References Cited

U.S. PATENT DOCUMENTS

| | | | |
|---|---|---|---|
| 7,132,635 | B2 | 11/2006 | Dowling |
| 7,132,785 | B2 | 11/2006 | Ducharme |
| 7,132,804 | B2 | 11/2006 | Lys et al. |
| 7,135,824 | B2 | 11/2006 | Lys et al. |
| 7,139,617 | B1 | 11/2006 | Morgan et al. |
| 7,144,135 | B2 | 12/2006 | Martin et al. |
| 7,153,002 | B2 | 12/2006 | Kim et al. |
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,164,110 | B2 | 1/2007 | Pitigoi-Aron et al. |
| 7,164,235 | B2 | 1/2007 | Ito et al. |
| 7,165,863 | B1 | 1/2007 | Thomas et al. |
| 7,165,866 | B2 | 1/2007 | Li |
| 7,167,777 | B2 | 1/2007 | Budike, Jr. |
| 7,168,843 | B2 | 1/2007 | Striebel |
| D536,468 | S | 2/2007 | Crosby |
| 7,178,941 | B2 | 2/2007 | Roberge et al. |
| 7,180,252 | B2 | 2/2007 | Lys et al. |
| D538,950 | S | 3/2007 | Maxik |
| D538,952 | S | 3/2007 | Maxik et al. |
| D538,962 | S | 3/2007 | Elliott |
| 7,186,003 | B2 | 3/2007 | Dowling et al. |
| 7,186,005 | B2 | 3/2007 | Hulse |
| 7,187,141 | B2 | 3/2007 | Mueller et al. |
| 7,190,126 | B1 | 3/2007 | Paton |
| 7,192,154 | B2 | 3/2007 | Becker |
| 7,198,387 | B1 | 4/2007 | Gloisten et al. |
| 7,201,491 | B2 | 4/2007 | Bayat et al. |
| 7,201,497 | B2 | 4/2007 | Weaver, Jr. et al. |
| 7,202,613 | B2 | 4/2007 | Morgan et al. |
| 7,204,615 | B2 | 4/2007 | Arik et al. |
| 7,204,622 | B2 | 4/2007 | Dowling et al. |
| 7,207,696 | B1 | 4/2007 | Lin |
| 7,210,818 | B2 | 5/2007 | Luk et al. |
| 7,210,957 | B2 | 5/2007 | Mrakovich et al. |
| 7,211,959 | B1 | 5/2007 | Chou |
| 7,213,934 | B2 | 5/2007 | Zarian et al. |
| 7,217,004 | B2 | 5/2007 | Park et al. |
| 7,217,012 | B2 | 5/2007 | Southard et al. |
| 7,217,022 | B2 | 5/2007 | Ruffin |
| 7,218,056 | B1 | 5/2007 | Harwood |
| 7,218,238 | B2 | 5/2007 | Right et al. |
| 7,220,015 | B2 | 5/2007 | Dowling |
| 7,220,018 | B2 | 5/2007 | Crabb et al. |
| 7,221,104 | B2 | 5/2007 | Lys et al. |
| 7,221,110 | B2 | 5/2007 | Sears et al. |
| 7,224,000 | B2 | 5/2007 | Aanegola et al. |
| 7,226,189 | B2 | 6/2007 | Lee et al. |
| 7,228,052 | B1 | 6/2007 | Lin |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,236,366 | B2 | 6/2007 | Chen |
| 7,237,924 | B2 | 7/2007 | Martineau et al. |
| 7,237,925 | B2 | 7/2007 | Mayer et al. |
| 7,239,532 | B1 | 7/2007 | Hsu et al. |
| 7,241,038 | B2 | 7/2007 | Naniwa et al. |
| 7,242,152 | B2 | 7/2007 | Dowling et al. |
| 7,246,926 | B2 | 7/2007 | Harwood |
| 7,246,931 | B2 | 7/2007 | Hsieh et al. |
| 7,248,239 | B2 | 7/2007 | Dowling et al. |
| 7,249,269 | B1 | 7/2007 | Motoyama |
| 7,249,865 | B2 | 7/2007 | Robertson |
| D548,868 | S | 8/2007 | Roberge et al. |
| 7,252,408 | B2 | 8/2007 | Mazzochette et al. |
| 7,253,566 | B2 | 8/2007 | Lys et al. |
| 7,255,457 | B2 | 8/2007 | Ducharme et al. |
| 7,255,460 | B2 | 8/2007 | Lee |
| 7,256,554 | B2 | 8/2007 | Lys |
| 7,258,458 | B2 | 8/2007 | Mochiachvili et al. |
| 7,258,467 | B2 | 8/2007 | Saccomanno et al. |
| 7,259,528 | B2 | 8/2007 | Pilz |
| 7,262,439 | B2 | 8/2007 | Setlur et al. |
| 7,262,559 | B2 | 8/2007 | Tripathi et al. |
| D550,379 | S | 9/2007 | Hoshikawa et al. |
| 7,264,372 | B2 | 9/2007 | Maglica |
| 7,267,467 | B2 | 9/2007 | Wu et al. |
| 7,270,443 | B2 | 9/2007 | Kurtz et al. |
| 7,271,794 | B1 | 9/2007 | Cheng et al. |
| 7,273,300 | B2 | 9/2007 | Mrakovich |
| 7,274,045 | B2 | 9/2007 | Chandran et al. |
| 7,274,160 | B2 | 9/2007 | Mueller et al. |
| 7,274,183 | B1 | 9/2007 | Gu et al. |
| D553,267 | S | 10/2007 | Yuen |
| 7,285,801 | B2 | 10/2007 | Eliashevich et al. |
| 7,288,902 | B1 | 10/2007 | Melanson |
| 7,288,904 | B2 | 10/2007 | Numeroli et al. |
| 7,296,912 | B2 | 11/2007 | Beauchamp |
| 7,300,184 | B2 | 11/2007 | Ichikawa et al. |
| 7,300,192 | B2 | 11/2007 | Mueller et al. |
| D556,937 | S | 12/2007 | Ly |
| D557,854 | S | 12/2007 | Lewis |
| 7,303,300 | B2 | 12/2007 | Dowling et al. |
| 7,306,353 | B2 | 12/2007 | Popovich et al. |
| 7,307,391 | B2 | 12/2007 | Shan |
| 7,308,296 | B2 | 12/2007 | Lys et al. |
| 7,309,965 | B2 | 12/2007 | Dowling et al. |
| 7,318,658 | B2 | 1/2008 | Wang et al. |
| 7,319,244 | B2 | 1/2008 | Liu et al. |
| 7,319,246 | B2 | 1/2008 | Soules et al. |
| 7,321,191 | B2 | 1/2008 | Setlur et al. |
| 7,326,964 | B2 | 2/2008 | Lim et al. |
| 7,327,281 | B2 | 2/2008 | Hutchison |
| 7,329,024 | B2 | 2/2008 | Lynch et al. |
| 7,329,031 | B2 | 2/2008 | Liaw et al. |
| D563,589 | S | 3/2008 | Hariri et al. |
| 7,344,278 | B2 | 3/2008 | Paravantsos |
| 7,345,320 | B2 | 3/2008 | Dahm |
| 7,348,604 | B2 | 3/2008 | Matheson |
| 7,350,936 | B2 | 4/2008 | Ducharme et al. |
| 7,350,952 | B2 | 4/2008 | Nishigaki |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,358,679 | B2 | 4/2008 | Lys et al. |
| 7,358,929 | B2 | 4/2008 | Mueller et al. |
| 7,370,986 | B2 | 5/2008 | Chan |
| 7,374,327 | B2 | 5/2008 | Schexnaider |
| 7,378,805 | B2 | 5/2008 | Oh et al. |
| 7,378,976 | B1 | 5/2008 | Paterno |
| 7,385,359 | B2 | 6/2008 | Dowling et al. |
| 7,391,159 | B2 | 6/2008 | Harwood |
| D574,093 | S | 7/2008 | Kitagawa et al. |
| 7,396,142 | B2 | 7/2008 | Laizure, Jr. et al. |
| 7,396,146 | B2 | 7/2008 | Wang |
| 7,401,935 | B2 | 7/2008 | VanderSchuit |
| 7,401,945 | B2 | 7/2008 | Zhang |
| D576,749 | S | 9/2008 | Kitagawa et al. |
| 7,423,548 | B2 | 9/2008 | Kontovich |
| 7,427,840 | B2 | 9/2008 | Morgan et al. |
| 7,429,117 | B2 | 9/2008 | Pohlert et al. |
| 7,434,964 | B1 | 10/2008 | Zheng et al. |
| 7,438,441 | B2 | 10/2008 | Sun et al. |
| D580,089 | S | 11/2008 | Ly et al. |
| D581,556 | S | 11/2008 | To et al. |
| 7,449,847 | B2 | 11/2008 | Schanberger et al. |
| D582,577 | S | 12/2008 | Yuen |
| 7,466,082 | B1 | 12/2008 | Snyder et al. |
| 7,470,046 | B2 | 12/2008 | Kao et al. |
| D584,428 | S | 1/2009 | Li et al. |
| D584,429 | S | 1/2009 | Pei et al. |
| 7,476,002 | B2 | 1/2009 | Wolf et al. |
| 7,476,004 | B2 | 1/2009 | Chan |
| 7,478,924 | B2 | 1/2009 | Robertson |
| 7,482,764 | B2 | 1/2009 | Morgan et al. |
| D586,484 | S | 2/2009 | Liu et al. |
| D586,928 | S | 2/2009 | Liu et al. |
| 7,490,957 | B2 | 2/2009 | Leong et al. |
| 7,497,596 | B2 | 3/2009 | Ge |
| 7,498,753 | B2 | 3/2009 | McAvoy et al. |
| 7,507,001 | B2 | 3/2009 | Kit |
| 7,510,299 | B2 | 3/2009 | Timmermans et al. |

(56) References Cited

U.S. PATENT DOCUMENTS

| | | | |
|---|---|---|---|
| 7,510,400 | B2 | 3/2009 | Glovatsky et al. |
| 7,514,876 | B2 | 4/2009 | Roach, Jr. |
| 7,520,635 | B2 | 4/2009 | Wolf et al. |
| 7,521,872 | B2 | 4/2009 | Bruning |
| 7,524,089 | B2 | 4/2009 | Park |
| D592,766 | S | 5/2009 | Zhu et al. |
| D593,223 | S | 5/2009 | Komar |
| 7,530,701 | B2 | 5/2009 | Chan-Wing |
| 7,534,002 | B2 | 5/2009 | Yamaguchi et al. |
| D594,999 | S | 6/2009 | Uchida et al. |
| 7,549,769 | B2 | 6/2009 | Kim et al. |
| 7,556,396 | B2 | 7/2009 | Kuo et al. |
| 7,559,663 | B2 | 7/2009 | Wong et al. |
| 7,562,998 | B1 | 7/2009 | Yen |
| D597,686 | S | 8/2009 | Noh |
| 7,569,981 | B1 | 8/2009 | Ciancanelli |
| 7,572,030 | B2 | 8/2009 | Booth et al. |
| 7,575,339 | B2 | 8/2009 | Hung |
| 7,579,786 | B2 | 8/2009 | Soos |
| 7,583,035 | B2 | 9/2009 | Shteynberg et al. |
| 7,583,901 | B2 | 9/2009 | Nakagawa et al. |
| 7,594,738 | B1 | 9/2009 | Lin et al. |
| D601,726 | S | 10/2009 | Mollaert et al. |
| 7,598,681 | B2 | 10/2009 | Lys et al. |
| 7,598,684 | B2 | 10/2009 | Lys et al. |
| 7,598,686 | B2 | 10/2009 | Lys et al. |
| 7,600,907 | B2 | 10/2009 | Liu et al. |
| 7,602,559 | B2 | 10/2009 | Jang et al. |
| 7,618,157 | B1 | 11/2009 | Galvez et al. |
| 7,619,366 | B2 | 11/2009 | Diederiks |
| 7,635,201 | B2 | 12/2009 | Deng |
| 7,635,214 | B2 | 12/2009 | Perlo |
| 7,639,517 | B2 | 12/2009 | Zhou et al. |
| 7,648,251 | B2 | 1/2010 | Whitehouse et al. |
| 7,649,327 | B2 | 1/2010 | Peng |
| D610,724 | S | 2/2010 | Chiang et al. |
| 7,661,839 | B2 | 2/2010 | Tsai |
| D612,528 | S | 3/2010 | McGrath et al. |
| 7,690,813 | B2 | 4/2010 | Kanamori et al. |
| 7,710,047 | B2 | 5/2010 | Shteynberg et al. |
| 7,710,253 | B1 | 5/2010 | Fredricks |
| 7,712,918 | B2 | 5/2010 | Siemiet et al. |
| 7,748,886 | B2 | 7/2010 | Pazula et al. |
| 7,758,207 | B1 | 7/2010 | Zhou et al. |
| 7,759,881 | B1 | 7/2010 | Melanson |
| D621,975 | S | 8/2010 | Wang |
| 7,784,966 | B2 | 8/2010 | Verfuerth et al. |
| 7,800,511 | B1 | 9/2010 | Hutchison et al. |
| 7,815,338 | B2 | 10/2010 | Siemiet et al. |
| 7,815,341 | B2 | 10/2010 | Steedly et al. |
| 7,828,471 | B2 | 11/2010 | Lin |
| 7,843,150 | B2 | 11/2010 | Wang et al. |
| 7,848,702 | B2 | 12/2010 | Ho et al. |
| 7,850,341 | B2 | 12/2010 | Mrakovich et al. |
| RE42,161 | E | 2/2011 | Hochstein |
| 7,878,683 | B2 | 2/2011 | Logan et al. |
| 7,887,216 | B2 | 2/2011 | Patrick |
| 7,887,226 | B2 | 2/2011 | Huang et al. |
| 7,889,051 | B1 | 2/2011 | Billig et al. |
| D634,452 | S | 3/2011 | de Visser |
| 7,926,975 | B2 | 4/2011 | Siemiet et al. |
| 7,938,562 | B2 | 5/2011 | Ivey et al. |
| 7,946,729 | B2 | 5/2011 | Ivey et al. |
| 7,952,292 | B2 | 5/2011 | Vegter et al. |
| 7,976,196 | B2 | 7/2011 | Ivey et al. |
| 7,990,070 | B2 | 8/2011 | Nerone |
| 7,997,770 | B1 | 8/2011 | Meurer |
| 8,013,472 | B2 | 9/2011 | Adest et al. |
| D650,097 | S | 12/2011 | Trumble et al. |
| D650,494 | S | 12/2011 | Tsao et al. |
| D652,968 | S | 1/2012 | Aguiar et al. |
| 8,093,823 | B1 | 1/2012 | Ivey et al. |
| D654,192 | S | 2/2012 | Maxik et al. |
| 8,118,447 | B2 | 2/2012 | Simon et al. |
| 8,147,091 | B2 | 4/2012 | Hsia et al. |
| 8,159,152 | B1 | 4/2012 | Salessi |
| D660,472 | S | 5/2012 | Aguiar et al. |
| 8,167,452 | B2 | 5/2012 | Chou |
| 8,177,388 | B2 | 5/2012 | Yen |
| 8,179,037 | B2 | 5/2012 | Chan et al. |
| 8,183,989 | B2 | 5/2012 | Tsai |
| D662,236 | S | 6/2012 | Matsushita |
| 8,203,445 | B2 | 6/2012 | Recker et al. |
| 8,214,084 | B2 | 7/2012 | Ivey et al. |
| 8,247,985 | B2 | 8/2012 | Timmermans et al. |
| 8,251,544 | B2 | 8/2012 | Ivey et al. |
| 8,262,249 | B2 | 9/2012 | Hsia et al. |
| 8,272,764 | B2 | 9/2012 | Son |
| 8,287,144 | B2 | 10/2012 | Pedersen et al. |
| 8,297,788 | B2 | 10/2012 | Bishop |
| 8,299,722 | B2 | 10/2012 | Melanson |
| 8,304,993 | B2 | 11/2012 | Tzou et al. |
| 8,313,213 | B2 | 11/2012 | Lin et al. |
| 8,319,407 | B2 | 11/2012 | Ke |
| 8,319,433 | B2 | 11/2012 | Lin et al. |
| 8,319,437 | B2 | 11/2012 | Carlin et al. |
| 8,322,878 | B2 | 12/2012 | Hsia et al. |
| 8,324,817 | B2 | 12/2012 | Ivey et al. |
| 8,337,071 | B2 | 12/2012 | Negley et al. |
| 8,376,579 | B2 | 2/2013 | Chang |
| 8,376,588 | B2 | 2/2013 | Yen |
| 8,382,322 | B2 | 2/2013 | Bishop |
| 8,382,327 | B2 | 2/2013 | Timmermans et al. |
| 8,382,502 | B2 | 2/2013 | Cao et al. |
| 8,388,179 | B2 | 3/2013 | Hood et al. |
| 8,398,275 | B2 | 3/2013 | Wang et al. |
| 8,403,692 | B2 | 3/2013 | Cao et al. |
| 8,405,314 | B2 | 3/2013 | Jensen |
| 8,434,914 | B2 | 5/2013 | Li et al. |
| 8,454,193 | B2 | 6/2013 | Simon et al. |
| 8,482,212 | B1 | 7/2013 | Ivey et al. |
| 8,571,716 | B2 | 10/2013 | Ivey et al. |
| 2001/0033488 | A1 | 10/2001 | Chliwnyj et al. |
| 2001/0045803 | A1 | 11/2001 | Cencur |
| 2002/0011801 | A1 | 1/2002 | Chang |
| 2002/0015297 | A1 | 2/2002 | Hayashi et al. |
| 2002/0038157 | A1 | 3/2002 | Dowling et al. |
| 2002/0041159 | A1 | 4/2002 | Kaping |
| 2002/0044066 | A1 | 4/2002 | Dowling et al. |
| 2002/0047516 | A1 | 4/2002 | Iwasa et al. |
| 2002/0047569 | A1 | 4/2002 | Dowling et al. |
| 2002/0047624 | A1 | 4/2002 | Stam et al. |
| 2002/0047628 | A1 | 4/2002 | Morgan et al. |
| 2002/0048169 | A1 | 4/2002 | Dowling et al. |
| 2002/0057061 | A1 | 5/2002 | Mueller et al. |
| 2002/0060526 | A1 | 5/2002 | Timmermans et al. |
| 2002/0070688 | A1 | 6/2002 | Dowling et al. |
| 2002/0074559 | A1 | 6/2002 | Dowling et al. |
| 2002/0074958 | A1 | 6/2002 | Crenshaw |
| 2002/0078221 | A1 | 6/2002 | Blackwell et al. |
| 2002/0101197 | A1 | 8/2002 | Lys et al. |
| 2002/0113555 | A1 | 8/2002 | Lys et al. |
| 2002/0130627 | A1 | 9/2002 | Morgan et al. |
| 2002/0145394 | A1 | 10/2002 | Morgan et al. |
| 2002/0145869 | A1 | 10/2002 | Dowling |
| 2002/0152045 | A1 | 10/2002 | Dowling et al. |
| 2002/0152298 | A1 | 10/2002 | Kikta et al. |
| 2002/0153851 | A1 | 10/2002 | Morgan et al. |
| 2002/0158583 | A1 | 10/2002 | Lys et al. |
| 2002/0163316 | A1 | 11/2002 | Lys et al. |
| 2002/0171365 | A1 | 11/2002 | Morgan et al. |
| 2002/0171377 | A1 | 11/2002 | Mueller et al. |
| 2002/0171378 | A1 | 11/2002 | Morgan et al. |
| 2002/0176259 | A1 | 11/2002 | Ducharme |
| 2002/0179816 | A1 | 12/2002 | Haines et al. |
| 2002/0195975 | A1 | 12/2002 | Schanberger et al. |
| 2003/0011538 | A1 | 1/2003 | Lys et al. |
| 2003/0021117 | A1 | 1/2003 | Chan |
| 2003/0028260 | A1 | 2/2003 | Blackwell |
| 2003/0031015 | A1 | 2/2003 | Ishibashi |
| 2003/0048641 | A1 | 3/2003 | Alexanderson et al. |
| 2003/0052599 | A1 | 3/2003 | Sun |
| 2003/0057884 | A1 | 3/2003 | Dowling et al. |
| 2003/0057886 | A1 | 3/2003 | Lys et al. |

(56) References Cited

U.S. PATENT DOCUMENTS

2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0218879 A1 11/2003 Tieszen
2003/0222587 A1 12/2003 Dowling, Jr. et al.
2003/0234342 A1 12/2003 Gaines et al.
2004/0003545 A1 1/2004 Gillespie
2004/0007980 A1 1/2004 Shibata
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0114371 A1 6/2004 Lea et al.
2004/0116039 A1 6/2004 Mueller et al.
2004/0124782 A1 7/2004 Yu
2004/0130908 A1 7/2004 McClurg et al.
2004/0130909 A1 7/2004 Mueller et al.
2004/0141321 A1 7/2004 Dowling et al.
2004/0145886 A1 7/2004 Fatemi et al.
2004/0155609 A1 8/2004 Lys et al.
2004/0160199 A1 8/2004 Morgan et al.
2004/0178751 A1 9/2004 Mueller et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0023536 A1 2/2005 Shackle
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0093488 A1 5/2005 Hung et al.
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0162093 A1 7/2005 Timmermans et al.
2005/0162100 A1 7/2005 Romano et al.
2005/0162101 A1 7/2005 Leong et al.
2005/0166634 A1 8/2005 Lieberman et al.
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0242742 A1 11/2005 Cheang et al.
2005/0243577 A1 11/2005 Moon
2005/0248299 A1 11/2005 Chemel et al.
2005/0253533 A1 11/2005 Lys et al.
2005/0259424 A1 11/2005 Zampini, II et al.
2005/0264474 A1 12/2005 Rast
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0281030 A1 12/2005 Leong et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0050509 A9 3/2006 Dowling et al.
2006/0050514 A1 3/2006 Opolka
2006/0056855 A1 3/2006 Nakagawa et al.
2006/0066447 A1 3/2006 Davenport et al.
2006/0076908 A1 4/2006 Morgan et al.
2006/0081863 A1 4/2006 Kim et al.
2006/0091826 A1 5/2006 Chen
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.
2006/0126338 A1 6/2006 Mighetto
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0215422 A1 9/2006 Laizure, Jr. et al.
2006/0220595 A1 10/2006 Lu
2006/0221606 A1 10/2006 Dowling et al.
2006/0221619 A1 10/2006 Nishigaki
2006/0227558 A1 10/2006 Osawa et al.
2006/0232974 A1 10/2006 Lee et al.
2006/0238884 A1 10/2006 Jang et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0265921 A1 11/2006 Korall et al.
2006/0273741 A1 12/2006 Stalker, III
2006/0274529 A1 12/2006 Cao

(56) References Cited

U.S. PATENT DOCUMENTS

2006/0285325 A1 12/2006 Ducharme et al.
2007/0035255 A1 2/2007 Shuster et al.
2007/0035538 A1 2/2007 Garcia et al.
2007/0035965 A1 2/2007 Holst
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0064425 A1 3/2007 Frecska et al.
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1 5/2007 Wolf et al.
2007/0115658 A1 5/2007 Mueller et al.
2007/0115665 A1 5/2007 Mueller et al.
2007/0120463 A1 5/2007 Hayashi et al.
2007/0120594 A1 5/2007 Balakrishnan et al.
2007/0127234 A1 6/2007 Jervey, III
2007/0133202 A1 6/2007 Huang et al.
2007/0139938 A1 6/2007 Petroski et al.
2007/0145915 A1 6/2007 Roberge et al.
2007/0146126 A1 6/2007 Wang
2007/0147046 A1 6/2007 Arik et al.
2007/0152797 A1 7/2007 Chemel et al.
2007/0152808 A1 7/2007 LaCasse
2007/0153514 A1 7/2007 Dowling et al.
2007/0159828 A1 7/2007 Wang
2007/0165402 A1 7/2007 Weaver, Jr. et al.
2007/0165405 A1 7/2007 Chen
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0200725 A1 8/2007 Fredericks et al.
2007/0205712 A1 9/2007 Radkov et al.
2007/0206375 A1 9/2007 Piepgras et al.
2007/0211461 A1 9/2007 Harwood
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0236358 A1 10/2007 Street et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247450 A1 10/2007 Lee
2007/0247842 A1 10/2007 Zampini et al.
2007/0247847 A1 10/2007 Villard
2007/0247851 A1 10/2007 Villard
2007/0252161 A1 11/2007 Meis et al.
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0024067 A1 1/2008 Ishibashi
2008/0029720 A1 2/2008 Li
2008/0037226 A1 2/2008 Shin et al.
2008/0037245 A1 2/2008 Chan
2008/0037284 A1 2/2008 Rudisill
2008/0049434 A1 2/2008 Marsh
2008/0055894 A1 3/2008 Deng
2008/0062680 A1 3/2008 Timmermans et al.
2008/0068838 A1 3/2008 Galke et al.
2008/0068839 A1 3/2008 Matheson
2008/0074872 A1 3/2008 Panotopoulos
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094819 A1 4/2008 Vaish
2008/0094837 A1 4/2008 Dobbins et al.
2008/0129211 A1 6/2008 Lin et al.
2008/0130267 A1 6/2008 Dowling et al.
2008/0150444 A1 6/2008 Usui et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0185961 A1 8/2008 Hong
2008/0186704 A1 8/2008 Chou et al.
2008/0192436 A1 8/2008 Peng et al.
2008/0198598 A1 8/2008 Ward
2008/0211386 A1 9/2008 Choi et al.
2008/0211419 A1 9/2008 Garrity
2008/0218993 A1 9/2008 Li
2008/0224629 A1 9/2008 Melanson
2008/0224636 A1 9/2008 Melanson
2008/0253125 A1 10/2008 Kang et al.
2008/0258631 A1 10/2008 Wu et al.
2008/0258647 A1 10/2008 Scianna
2008/0278092 A1 11/2008 Lys et al.
2008/0285257 A1 11/2008 King
2008/0285266 A1 11/2008 Thomas
2008/0290814 A1 11/2008 Leong et al.
2008/0291675 A1 11/2008 Lin et al.
2008/0298080 A1 12/2008 Wu et al.
2008/0310119 A1 12/2008 Giacoma
2008/0315773 A1 12/2008 Pang
2008/0315784 A1 12/2008 Tseng
2009/0002995 A1 1/2009 Lee et al.
2009/0010022 A1 1/2009 Tsai
2009/0016063 A1 1/2009 Hu
2009/0021140 A1 1/2009 Takasu et al.
2009/0046473 A1 2/2009 Tsai et al.
2009/0052186 A1 2/2009 Xue
2009/0059557 A1 3/2009 Tanaka
2009/0059559 A1 3/2009 Pabst et al.
2009/0059603 A1 3/2009 Recker et al.
2009/0067170 A1 3/2009 Bloemen et al.
2009/0067182 A1 3/2009 Hsu et al.
2009/0073693 A1 3/2009 Nall et al.
2009/0085500 A1 4/2009 Zampini, II et al.
2009/0086492 A1 4/2009 Meyer
2009/0091929 A1 4/2009 Faubion
2009/0091938 A1 4/2009 Jacobson et al.
2009/0101930 A1 4/2009 Li
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0189540 A1 7/2009 Huang et al.
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0231831 A1 9/2009 Hsiao et al.
2009/0268461 A1 10/2009 Deak et al.

(56) References Cited

U.S. PATENT DOCUMENTS

2009/0273924 A1 11/2009 Chiang
2009/0273926 A1 11/2009 Deng
2009/0284169 A1 11/2009 Valois
2009/0290334 A1 11/2009 Ivey et al.
2009/0295776 A1 12/2009 Yu et al.
2009/0296381 A1 12/2009 Dubord
2009/0303720 A1 12/2009 McGrath
2009/0316408 A1 12/2009 Villard
2010/0008085 A1 1/2010 Ivey et al.
2010/0019689 A1 1/2010 Shan
2010/0027259 A1 2/2010 Simon et al.
2010/0033095 A1 2/2010 Sadwick
2010/0033964 A1 2/2010 Choi et al.
2010/0046210 A1 2/2010 Mathai et al.
2010/0046222 A1 2/2010 Yang
2010/0071946 A1 3/2010 Hashimoto
2010/0073944 A1 3/2010 Chen
2010/0079085 A1 4/2010 Wendt et al.
2010/0096992 A1 4/2010 Yamamoto et al.
2010/0096998 A1 4/2010 Beers
2010/0103664 A1 4/2010 Simon et al.
2010/0103673 A1 4/2010 Ivey et al.
2010/0109550 A1 5/2010 Huda et al.
2010/0109558 A1 5/2010 Chew
2010/0141173 A1 6/2010 Negrete
2010/0148650 A1 6/2010 Wu et al.
2010/0149806 A1 6/2010 Yiu
2010/0157608 A1 6/2010 Chen et al.
2010/0164404 A1 7/2010 Shao et al.
2010/0181178 A1 7/2010 Chang et al.
2010/0201269 A1 8/2010 Tzou et al.
2010/0207547 A1 8/2010 Kuroki et al.
2010/0220469 A1 9/2010 Ivey et al.
2010/0237790 A1 9/2010 Peng
2010/0265732 A1 10/2010 Liu
2010/0270925 A1 10/2010 Withers
2010/0277069 A1 11/2010 Janik et al.
2010/0289418 A1 11/2010 Langovsky
2010/0308733 A1 12/2010 Shao
2010/0309652 A1 12/2010 Shen et al.
2010/0320922 A1 12/2010 Palazzolo et al.
2011/0006658 A1 1/2011 Chan et al.
2011/0090682 A1 4/2011 Zheng et al.
2011/0109454 A1 5/2011 McSheffrey, Sr.
2011/0112661 A1 5/2011 Jung et al.
2011/0156584 A1 6/2011 Kim
2011/0176298 A1 7/2011 Meurer et al.
2011/0199723 A1 8/2011 Sato
2011/0199769 A1 8/2011 Bretschneider et al.
2011/0204777 A1 8/2011 Lenk
2011/0291588 A1 12/2011 Tagare
2012/0008315 A1* 1/2012 Simon et al. ..... 362/217.13
2012/0014086 A1 1/2012 Jonsson
2012/0043892 A1 2/2012 Visser et al.
2012/0063140 A1 3/2012 Kong
2012/0080994 A1 4/2012 Chin et al.
2012/0081891 A1 4/2012 Tung et al.
2012/0098439 A1 4/2012 Recker et al.
2012/0106144 A1 5/2012 Chang
2012/0113628 A1 5/2012 Burrow et al.
2012/0127726 A1 5/2012 Yen
2012/0146503 A1 6/2012 Negley et al.
2012/0147597 A1 6/2012 Farmer
2012/0153865 A1 6/2012 Rolfes et al.
2012/0155073 A1 6/2012 McCanless et al.
2012/0161666 A1 6/2012 Antony et al.
2012/0194086 A1 8/2012 Liu et al.
2012/0195032 A1 8/2012 Shew
2012/0212951 A1 8/2012 Lai et al.
2012/0212953 A1 8/2012 Bloom et al.
2012/0230044 A1 9/2012 Zhang et al.
2012/0236533 A1 9/2012 Nakamura et al.
2012/0236554 A1 9/2012 Rust
2012/0243216 A1 9/2012 Lai et al.
2012/0243217 A1 9/2012 Szprengiel et al.
2012/0274214 A1 11/2012 Radermacher et al.
2012/0275154 A1 11/2012 Hood et al.
2012/0293991 A1 11/2012 Lin
2012/0293996 A1 11/2012 Thomas et al.
2012/0300445 A1 11/2012 Chu et al.
2012/0300468 A1 11/2012 Chang et al.
2012/0300486 A1 11/2012 Matsushita et al.
2012/0307524 A1 12/2012 Schapira et al.
2012/0320598 A1 12/2012 Son
2013/0039051 A1 2/2013 Wu
2013/0044471 A1 2/2013 Chen
2013/0044476 A1 2/2013 Bretschneider et al.
2013/0050997 A1 2/2013 Bretschneider et al.
2013/0050998 A1 2/2013 Chu et al.
2013/0057146 A1 3/2013 Chao
2013/0058079 A1 3/2013 Dellian et al.
2013/0063944 A1 3/2013 Lodhie et al.
2013/0077297 A1 3/2013 Wu et al.
2013/0094200 A1 4/2013 Dellian et al.
2013/0148349 A1 6/2013 Pasqualini et al.
2013/0200797 A1 8/2013 Timmermans et al.
2013/0201690 A1 8/2013 Vissenberg et al.
2013/0206597 A1 8/2013 Wang et al.
2013/0221867 A1 8/2013 Deppe et al.
2013/0242553 A1 9/2013 Feng et al.
2013/0250610 A1 9/2013 Brick et al.
2013/0258668 A1 10/2013 Dellian et al.
2014/0009926 A1* 1/2014 Simon et al. ..... 362/222

FOREIGN PATENT DOCUMENTS

CN 2869556 Y 2/2007
CN 101016976 A 8/2007
CN 101075605 A 11/2007
CN 201129681 Y 10/2008
CN 201184574 Y 1/2009
CN 101737664 A1 6/2010
DE 19651140 A1 6/1997
DE 19624087 A1 12/1997
DE 29819966 U1 3/1999
DE 29900320 U1 5/1999
DE 29817609 U1 1/2000
DE 20018865 U1 2/2001
EP 0013782 B1 3/1983
EP 0091172 A2 10/1983
EP 0124924 B1 9/1987
EP 0174699 B1 11/1988
EP 0197602 B1 11/1990
EP 0214701 B1 3/1992
EP 0262713 B1 6/1992
EP 0203668 B1 2/1993
EP 0272749 B1 8/1993
EP 0337567 B1 11/1993
EP 0390262 B1 12/1993
EP 0359329 B1 3/1994
EP 0403011 B1 4/1994
EP 0632511 1/1995
EP 0432848 B1 4/1995
EP 0659531 A1 6/1995
EP 0403001 B1 8/1995
EP 0525876 5/1996
EP 0714556 1/1999
EP 0889283 A1 7/1999
EP 0458408 B1 9/1999
EP 0578302 B1 9/1999
EP 0723701 B1 1/2000
EP 0787419 B1 5/2001
EP 1195740 A2 4/2002
EP 1016062 B1 8/2002
EP 1195740 A3 1/2003
EP 1149510 B1 2/2003
EP 1056993 B1 3/2003
EP 0766436 B1 5/2003
EP 0924281 B1 5/2003
EP 0826167 B1 6/2003
EP 1147686 B1 1/2004
EP 1142452 B1 3/2004
EP 1145602 B1 3/2004
EP 1422975 A1 5/2004

(56) References Cited

FOREIGN PATENT DOCUMENTS

| | | | |
|---|---|---|---|
| EP | 0890059 | B1 | 6/2004 |
| EP | 1348319 | B1 | 6/2005 |
| EP | 1037862 | B1 | 7/2005 |
| EP | 1346609 | B1 | 8/2005 |
| EP | 1321012 | B1 | 12/2005 |
| EP | 1610593 | | 12/2005 |
| EP | 1624728 | A1 | 2/2006 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | | 6/2007 |
| EP | 0922305 | B1 | 8/2007 |
| EP | 0922306 | B1 | 8/2007 |
| EP | 1194918 | B1 | 8/2007 |
| EP | 1833035 | A1 | 9/2007 |
| EP | 1048085 | B1 | 11/2007 |
| EP | 1852648 | A1 | 11/2007 |
| EP | 1763650 | B1 | 12/2007 |
| EP | 1776722 | B1 | 1/2008 |
| EP | 1873012 | | 1/2008 |
| EP | 1459599 | B1 | 2/2008 |
| EP | 1887836 | A2 | 2/2008 |
| EP | 1579733 | B1 | 4/2008 |
| EP | 1145282 | B1 | 7/2008 |
| EP | 1157428 | B1 | 9/2008 |
| EP | 1000522 | B1 | 12/2008 |
| EP | 1502483 | B1 | 12/2008 |
| EP | 1576858 | B1 | 12/2008 |
| EP | 1646092 | B1 | 1/2009 |
| EP | 1579736 | B1 | 2/2009 |
| EP | 1889519 | | 3/2009 |
| EP | 1537354 | B1 | 4/2009 |
| EP | 1518445 | B1 | 5/2009 |
| EP | 1337784 | B1 | 6/2009 |
| EP | 2013530 | B1 | 8/2009 |
| EP | 1461982 | B1 | 9/2009 |
| EP | 2333407 | A1 | 6/2011 |
| EP | 2430888 | | 3/2012 |
| EP | 2469155 | A1 | 6/2012 |
| EP | 2573457 | A1 | 3/2013 |
| EP | 2554895 | A1 | 6/2013 |
| FR | 2813115 | | 2/2002 |
| GB | 2215024 | A | 9/1989 |
| GB | 2324901 | A | 11/1998 |
| GB | 2447257 | A | 9/2008 |
| GB | 2472345 | A | 2/2011 |
| GB | 2486410 | A | 6/2012 |
| GB | 2495647 | A | 4/2013 |
| JP | S68248271A | A | 10/1987 |
| JP | 06-054289 | | 2/1994 |
| JP | H6-54103 | U | 7/1994 |
| JP | 07-249467 | | 9/1995 |
| JP | 7264036 | | 10/1995 |
| JP | 08-162677 | A | 6/1996 |
| JP | H11-135274 | A | 5/1999 |
| JP | H11-162234 | A | 6/1999 |
| JP | H11-260125 | A | 9/1999 |
| JP | 2001-238272 | A | 8/2001 |
| JP | 2001-291406 | A | 10/2001 |
| JP | 2002-141555 | A | 5/2002 |
| JP | 3098271 | U | 2/2004 |
| JP | 2004-119078 | A | 4/2004 |
| JP | 2004-273234 | A | 9/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 2005-322866 | A | 12/2006 |
| JP | 2007-227342 | A | 9/2007 |
| JP | 3139714 | U | 2/2008 |
| JP | 2008-186758 | A | 8/2008 |
| JP | 2008-258124 | A | 10/2008 |
| JP | 2008-293753 | A | 12/2008 |
| JP | 3154200 | | 9/2009 |
| JP | 2010-15754 | | 1/2010 |
| JP | 2010-192229 | A1 | 9/2010 |
| JP | 2010-205553 | A | 9/2010 |
| JP | 5102530 | B2 | 12/2012 |
| KR | 10-2004-0008244 | A | 1/2004 |
| KR | 10-2006-0112113 | A | 10/2006 |
| KR | 20-0430022 | Y1 | 11/2006 |
| KR | 10-2006-0133784 | A | 12/2006 |
| KR | 10-2007-0063595 | A | 6/2007 |
| KR | 10-0781652 | | 12/2007 |
| KR | 10-0844538 | B1 | 7/2008 |
| KR | 10-0888669 | B1 | 3/2009 |
| KR | 10-0927851 | B1 | 11/2009 |
| TW | M337036 | | 7/2008 |
| TW | M349465 | U | 1/2009 |
| WO | WO9906759 | A1 | 2/1999 |
| WO | WO9910867 | A1 | 3/1999 |
| WO | WO9931560 | A2 | 6/1999 |
| WO | WO9945312 | A1 | 9/1999 |
| WO | WO9957945 | A1 | 11/1999 |
| WO | WO0001067 | A2 | 1/2000 |
| WO | WO2011072308 | A1 | 6/2001 |
| WO | WO0225842 | A2 | 3/2002 |
| WO | WO02061330 | A2 | 8/2002 |
| WO | WO02069306 | A2 | 9/2002 |
| WO | WO02091805 | A2 | 11/2002 |
| WO | WO02098182 | A2 | 12/2002 |
| WO | WO02099780 | A2 | 12/2002 |
| WO | WO03026358 | A1 | 3/2003 |
| WO | WO03055273 | A2 | 7/2003 |
| WO | WO03067934 | A2 | 8/2003 |
| WO | WO03090890 | A1 | 11/2003 |
| WO | WO03096761 | A1 | 11/2003 |
| WO | WO2004021747 | A2 | 3/2004 |
| WO | WO2004023850 | A2 | 3/2004 |
| WO | WO2004032572 | A2 | 4/2004 |
| WO | WO2004057924 | A1 | 7/2004 |
| WO | WO2004100624 | A2 | 11/2004 |
| WO | WO2005031860 | A2 | 4/2005 |
| WO | WO2005052751 | A2 | 6/2005 |
| WO | WO2005060309 | A2 | 6/2005 |
| WO | WO2005116519 | A1 | 8/2005 |
| WO | WO2005084339 | A2 | 9/2005 |
| WO | WO2005089293 | A2 | 9/2005 |
| WO | WO2005089309 | A2 | 9/2005 |
| WO | WO2005103555 | A1 | 11/2005 |
| WO | WO2006023149 | A2 | 3/2006 |
| WO | WO2006044328 | A1 | 4/2006 |
| WO | WO2006046207 | A1 | 5/2006 |
| WO | WO2006056120 | A1 | 6/2006 |
| WO | WO2006093889 | A2 | 9/2006 |
| WO | WO2006095315 | | 9/2006 |
| WO | WO2006095316 | | 9/2006 |
| WO | WO2006127666 | A2 | 11/2006 |
| WO | WO2006127785 | A2 | 11/2006 |
| WO | WO2006133272 | A2 | 12/2006 |
| WO | WO2006137686 | A1 | 12/2006 |
| WO | WO2007004679 | A1 | 1/2007 |
| WO | WO2007081674 | A1 | 7/2007 |
| WO | WO2007090292 | A1 | 8/2007 |
| WO | WO2007094810 | A2 | 8/2007 |
| WO | WO2008018002 | A2 | 2/2008 |
| WO | WO2008027093 | A2 | 3/2008 |
| WO | WO2008061991 | A1 | 5/2008 |
| WO | WO2008110978 | A1 | 9/2008 |
| WO | WO2008129488 | | 10/2008 |
| WO | WO2008137460 | | 11/2008 |
| WO | WO2009061124 | A2 | 5/2009 |
| WO | WO2009067074 | A1 | 5/2009 |
| WO | WO2009111978 | A1 | 9/2009 |
| WO | WO2009143047 | A2 | 11/2009 |

(56) References Cited

FOREIGN PATENT DOCUMENTS

| | | | |
|---|---|---|---|
| WO | WO2010014437 | A2 | 2/2010 |
| WO | WO2010030509 | A2 | 3/2010 |
| WO | WO2010047896 | A2 | 4/2010 |
| WO | WO2010047898 | A2 | 4/2010 |
| WO | WO2010047973 | A2 | 4/2010 |
| WO | WO2010069983 | A1 | 6/2010 |
| WO | WO2010083370 | A2 | 7/2010 |
| WO | WO2010088105 | A3 | 8/2010 |
| WO | WO2010132625 | A2 | 11/2010 |
| WO | WO2010141537 | A2 | 12/2010 |
| WO | WO2011005562 | | 1/2011 |
| WO | WO2011005579 | A2 | 1/2011 |
| WO | WO2011021719 | A1 | 2/2011 |
| WO | WO2011074884 | A2 | 6/2011 |
| WO | WO2011113709 | A1 | 9/2011 |
| WO | WO2011117059 | A1 | 9/2011 |
| WO | WO2011159436 | A2 | 12/2011 |
| WO | WO2012001584 | A1 | 1/2012 |
| WO | WO2012004708 | A2 | 1/2012 |
| WO | WO2012007899 | A1 | 1/2012 |
| WO | WO2012019535 | A1 | 2/2012 |
| WO | WO2012025626 | A1 | 3/2012 |
| WO | WO2012063174 | A2 | 5/2012 |
| WO | WO2012117018 | A1 | 9/2012 |
| WO | WO2012129301 | A1 | 9/2012 |
| WO | WO2012131522 | A1 | 10/2012 |
| WO | WO2012131547 | A1 | 10/2012 |
| WO | WO2013028965 | A2 | 2/2013 |
| WO | WO2013029960 | A1 | 3/2013 |
| WO | WO2013030128 | A2 | 3/2013 |
| WO | WO2013045255 | A1 | 4/2013 |
| WO | WO2013045439 | A1 | 4/2013 |
| WO | WO2013057660 | A2 | 4/2013 |
| WO | WO2013079242 | A1 | 6/2013 |
| WO | WO2013088299 | A1 | 6/2013 |
| WO | WO2013097823 | A1 | 7/2013 |
| WO | WO2013098700 | A1 | 7/2013 |
| WO | WO2013113548 | A1 | 8/2013 |
| WO | WO2013113661 | A1 | 8/2013 |
| WO | WO2013121347 | A1 | 8/2013 |
| WO | WO2013132383 | A1 | 9/2013 |
| WO | WO2013135527 | A1 | 9/2013 |
| WO | WO2013156905 | A1 | 10/2013 |
| WO | WO2013167419 | A1 | 11/2013 |

OTHER PUBLICATIONS

Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.

Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.

D.N.A.—III, [online], [retrieved Mar. 10, 2009] Retrieved from the PLC Lighting Web Page using Internet <URL: http://www.plclighting.com/product_info. php?cPath=1&products_id=92>.

E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.

E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.

E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.

E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.

E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.

Extended European Search Report for co-pending European Application No. 10 73 2124 mailed on Dec. 13, 2012 in 8 pages.

Extended European Search Report for co-pending European Application No. 09822425.6 mailed on Aug. 30, 2012 in 9 pages.

Extended European Search Report for co-pending European Application No. 10797596.3 mailed on Jan. 17, 2013 in 11pages.

Extended European Search Report for co-pending European Application No. 10736237.8 mailed on Oct. 19, 2012 in 5 pages.

Extended European Search Report for co-pending European Application No. 10738925.6 mailed on Oct. 1, 2012 in 7 pages.

Extended European Search Report for co-pending European Application No. 11760309 mailed on Sep. 30, 2013 in 7 pages.

Examination and Search Report mailed on Jul. 2, 2012 in cooresponding United Kingdom Application No. 1018896.9 in 4 pages.

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/1abs/ballast.pdf.>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.

Hightower et al, "A Survey and Taxonomy of Location Systems for Ubiquitous Computing", University of Washington, Computer Science and Engineering, Technical Report UW-CSE 01-08-03, IEEE, Aug. 24, 2001 in 29 pages.

International Search Report and Written Opinion dated Jan. 4, 2010 from the corresponding International Application No. PCT/US2009/044313 filed May 18, 2009.

International Search Report and Written Opinion dated Feb. 7, 2011 from the corresponding International Application No. PCT/US2010/039678 filed Jun. 23, 2010.

International Search Report and Written Opinion dated May 7, 2010 from the corresponding International Application No. PCT/US2009/057109 filed on Sep. 16, 2009.

International Search Report and Written Opinion dated Apr. 8, 2010 from the corresponding International Application No. PCT/2009/055114 filed on Aug. 27, 2009.

International Search Report and Written Opinion dated Feb. 8, 2011 from the corresponding International Application No. PCT/US2010/039608 filed Jun. 23, 2010.

International Search Report and Written Opinion dated Dec. 13, 2010 from the corresponding International Application No. PCT/US2010/037006 filed Jun. 2, 2010.

International Search Report and Written Opinion dated Mar. 13, 2012 from the corresponding International Application No. PCT/US2011/052995 filed on Sep. 23, 2011.

International Search Report and Written Opinion dated May 14, 2010 from the corresponding International Application No. PCT/US2009/060085 filed Oct. 9, 2009.

International Search Report and Written Opinion dated Aug. 16, 2010 from the corresponding International Application No. PCT/US2010/021131 filed on Jan. 15, 2010.

International Search Report and Written Opinion dated Jul. 16, 2009 from the corresponding International Application No. PCT/US2008/084650 filed Nov. 25, 2008.

International Search Report and Written Opinion dated Aug. 17, 2010 from the corresponding International Application No. PCT/US2010/021489 filed on Jan. 20, 2010.

International Search Report and Written Opinion dated Jul. 17, 2009 from the corresponding International Application No. PCT/US2008/085118 filed Dec. 1, 2008.

International Search Report and Written Opinion dated Nov. 21, 2011 from the corresponding International Application No. PCT/US2011/029932 filed on Mar. 25, 2011.

International Search Report and Written Opinion dated Mar. 22, 2010 from the corresponding International Application No. PCT/US2009/053853 filed Aug. 14, 2009.

(56) References Cited

OTHER PUBLICATIONS

International Search Report and Written Opinion dated Nov. 23, 2011 from the corresponding International Application No. PCT/US2011/042761 filed on Jul. 1, 2011.
International Search Report and Written Opinion dated Nov. 23, 2011 from the corresponding International Application No. PCT/US2011/042775 filed on Jul. 1, 2011.
International Search Report and Written Opinion dated Dec. 24, 2010 from the corresponding International Application No. PCT/US2010/034635 filed May 13, 2010.
International Search Report and Written Opinion dated May 24, 2010 from the corresponding International Application No. PCT/2009/060083 filed Oct. 9, 2009.
International Search Report and Written Opinion dated May 24, 2010 from the corresponding International Application No. PCT/US2009/060087 filed Oct. 9, 2009.
International Search Report and Written Opinion dated Aug. 25, 2009 from corresponding International Application No. PCT/US2009/031049 filed Jan. 15, 2009.
International Search Report and Written Opinion dated Jan. 25, 2010 from the corresponding International Application No. PCT/US2009/048623 filed Jun. 25, 2009.
International Search Report and Written Opinion dated Feb. 26, 2010 from the corresponding International Application No. PCT/US2009/050949 filed Jul. 17, 2009.
International Search Report and Written Opinion dated Apr. 30, 2010 from the corresponding International Application No. PCT/US2009/057072 filed on Sep. 16, 2009.
International Search Report and Written Opinion dated Jul. 30, 2010 from the corresponding International Application No. PCT/US2010/021448 filed on Jan. 20, 2010.
International Search Report and Written Opinion dated Sep. 30, 2011 from the corresponding International Application No. PCT/US2011/029905 filed on Mar. 25, 2011.
International Search Report and Written Opinion dated Feb. 6, 2012 from the corresponding International Application No. PCT/US2011/043524 filed on Jul. 11, 2011.
International Search Report and Written Opinion dated Feb. 15, 2013 from the corresponding International Application No. PCT/US22012/052244 filed on Aug. 24, 2012.
International Search Report and Written Opinion dated Aug. 30, 2011 for the corresponding International Application No. PCT/US2011/029994 filed Mar. 25, 2011.
International Search Report and Written Opinion dated Aug. 13, 2013 for the corresponding International Application No. PCT/US2013/028669 filed Mar. 1, 2013.
International Search Report and Written Opinion dated Sep. 23, 2013 for the corresponding International Application No. PCT/US2013/049432 filed Jul. 5, 2013.
International Search Report and Written Opinion dated Oct. 10, 2013 for the corresponding International Application No. PCT/US2013/049427 filed Jul. 5, 2013.
Notification of Transmittal, the International Search Report and the Written Opinion of the International Searching Authority dated May 7, 2012, from the corresponding International Application No. PCT/US2011/064151.
Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.
LCD Optics 101 Tutorial [online]. 3M Corporation, [retrieved on Jan. 6, 2010]. Retrieved from the internet: <URL: http://solutions.3m.com/wps/portal/3M/en_US/Vikuiti1/BrandProducts/secondary/optics101/>.
LED Lights, Replacement LED lamps for any incandescent light, [online], [retrieved on Jan. 13, 2000] Retrieved from LED Lights Web Page using Internet <URL: http://www.ledlights.com/replac.htm>.
LEDTronics, LEDTronics Catalog, 1996, p. 10, LEDTronics, Torrance, California.
Phason Electronic Control Systems, Light Level Controller (LLC) case study. Nov. 30, 2004. 3 pages, Phason Inc., Winnipeg, Manitoba, Canada.
Philips. Sense and Simplicity—Licensing program for LED Luminaires and Retrofits, Philips Intellectual Property & Standards, May 5, 2009.
Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.
PLC-81756-AL "Fireball" Contemporary Pendant Light, [online], [retrieved on Feb. 27, 2009] Retrieved from the Arcadian Lighting Web Page using Internet <URL: http://www.arcadianlighting .com/plc-81756-al.html>.
PLC-96973-PC PLC Lighting Elegance Modern/Contemporary Pendant Light, [online], [retrieved on Feb. 27, 2009] Retrieved from the Arcadian Lighting Web Page using Internet <URL: http/www.arcadianlighting.com/plc-96978-pc.html>.
Saha et al, "Location Determination of a Mobile Device using IEEE 802.11 Access Point Signals", May 5, 2002 in 20 pages.
Sensor Switch, nLight Lighting Control System, [online], [retrieved on Jan. 11, 2008] Retrieved from Sensor Switch web page using Internet <URL: http://www.sensorswitch.com>.
Six Strategies, [online], [retrieved on Jan. 11, 2008] Retrieved from Encelium Technologies Inc. Web Page using Internet <URL: http://www.encelium.com/products/strategies.html>.
Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_10000000000000056772>.
Supplementary European Search Report for corresponding European Application No. 10797603.7 mailed Aug. 5, 2013 in 5 pages.
Supplementary European Search Report for corresponding European Application No. 09822381.1 mailed Jan. 4, 2013 in 5 pages.
Supplementary European Search Report dated Feb. 22, 2012 from European Patent Application No. 09822424.9.
Telecite Products & Services—Display Options, [online], [retrieved on Jan. 13, 2000] Retrieved from Telecite Web page using Internet <URL: http://www.telecite.com/en/products/options en.htm>.
Traffic Signal Products—Transportation Products Group, [online], [retrieved on Jan. 13, 2000] Retrieved from the Dialight Web Page using Internet <URL: http://www.dialight.com/trans.htm>.
Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.
Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.
Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.
Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.
Notification of Transmittal, the International Search Report and the Written Opinion of the International Searching Authority dated May 7, 2012 from the corresponding International Application No. PCT/US2011/058312.
Bose, "Modern Power Electronics, Evolution, Technology and Applications", 1992, IEEE Press, pp. 14-15.
Kularatna, "Power Electronics Design Handbook, Low-power Components and Applications", 1998, Newns, pp. 71-75.
Lighting Handbook, 8th Edition, Illuminating Engineering Society of North America, 1993, pp. 237-240.
Hodapp, "Chapter 6: Applications for High-Brightness Light-Emitting Diodes", Hodapp, Academic Press, 1997, pp. 334-336, "High Brightness Light Emitting Diodes", Stringfellow et al., volume editors.

* cited by examiner

LENS FOR AN LED-BASED LIGHT

CROSS REFERENCE TO RELATED APPLICATIONS

This application claims priority to U.S. Provisional Patent Application No. 61/888,742 filed Oct. 9, 2013, the entire contents of which is incorporated herein by reference.

TECHNICAL FIELD

The embodiments disclosed herein relate to a light emitting diode (LED)-based light for replacing a fluorescent light in a standard fluorescent light fixture.

BACKGROUND

Fluorescent lights are widely used in a variety of locations, such as schools and office buildings. Although conventional fluorescent lights have certain advantages over, for example, incandescent lights, they also pose certain disadvantages including, inter alia, disposal problems due to the presence of toxic materials within the light.

LED-based lights designed as one-for-one replacements for fluorescent lights have appeared in recent years.

SUMMARY

Disclosed herein are embodiments of LED-based lights. In one aspect, an LED-based replacement light for a fluorescent light comprises: a plurality of LEDs; an elongate housing for the LEDs, the housing defined at least in part by a lens and having a cross sectional profile that partially falls along a cross sectional profile of a fluorescent light that the LED-based light is designed to replace, with at least a portion of the lens extending beyond the cross sectional profile of the fluorescent light; and at least one connector arranged at an end of the housing, the connector configured for engagement with a socket of a fluorescent light fixture.

In another aspect, an LED-based replacement light for a fluorescent light comprises: a plurality of LEDs; an elongate housing for the LEDs, the housing at least partially defined by an opaque lower portion and a lens including an inner lens and an outer lens spaced apart from the inner lens, wherein the cross sectional profiles of the lower portion and the inner lens at least partially fall along a cross sectional profile of a fluorescent light that the LED-based light is designed to replace, with at least a portion of the outer lens extending beyond the cross sectional profile of the fluorescent light; and at least one connector arranged at an end of the housing, the connector configured for engagement with a socket of a fluorescent light fixture.

In yet another aspect, an LED-based light comprises a plurality of LEDs; an elongate housing for the LEDs, the housing at least partially defined by a lens including an inner lens and an outer lens spaced from the inner lens, wherein both the inner lens and the outer lens have an at least partially curved cross sectional profile facing in a common direction away from the plurality of LEDs; and at least one connector arranged at an end of the housing, the connector configured for engagement with a socket of a fluorescent light fixture.

These and other aspects will be described in additional detail below.

BRIEF DESCRIPTION OF THE DRAWINGS

The various features, advantages and other uses of the present apparatus will become more apparent by referring to the following detailed description and drawings in which.

DETAILED DESCRIPTION

This disclosure relates to the structure of the lens of an LED-based light. In one example implementation, the lens includes a lens surface configured to transmit light emanating from the LEDs of the LED-based light and provide a relatively greater diffusive capability to the lens as compared to lenses of typical LED-based lights.

Figure 1:
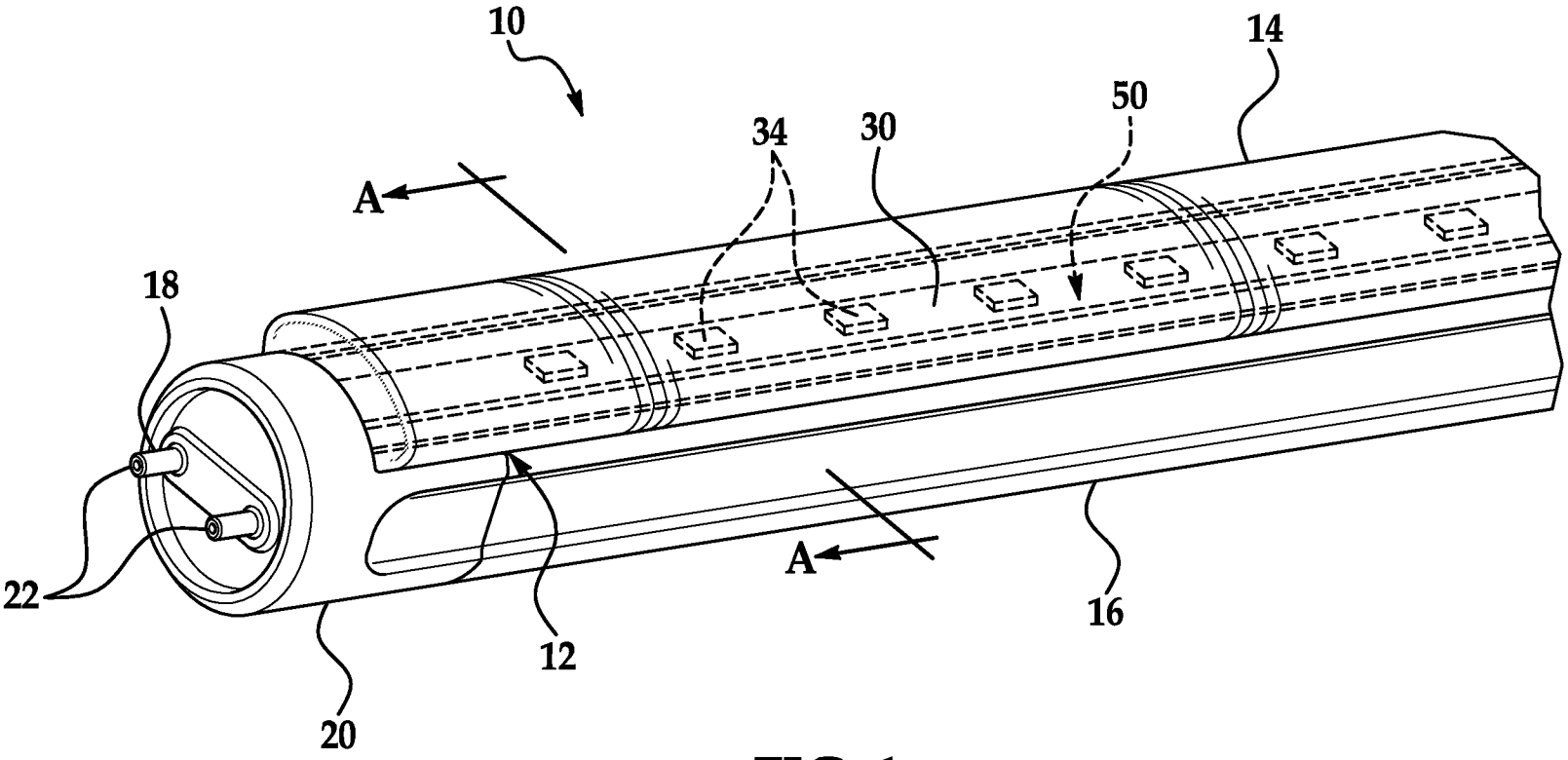
FIG. 1 is a partial perspective view of an example of an LED-based light.
Figure 2:
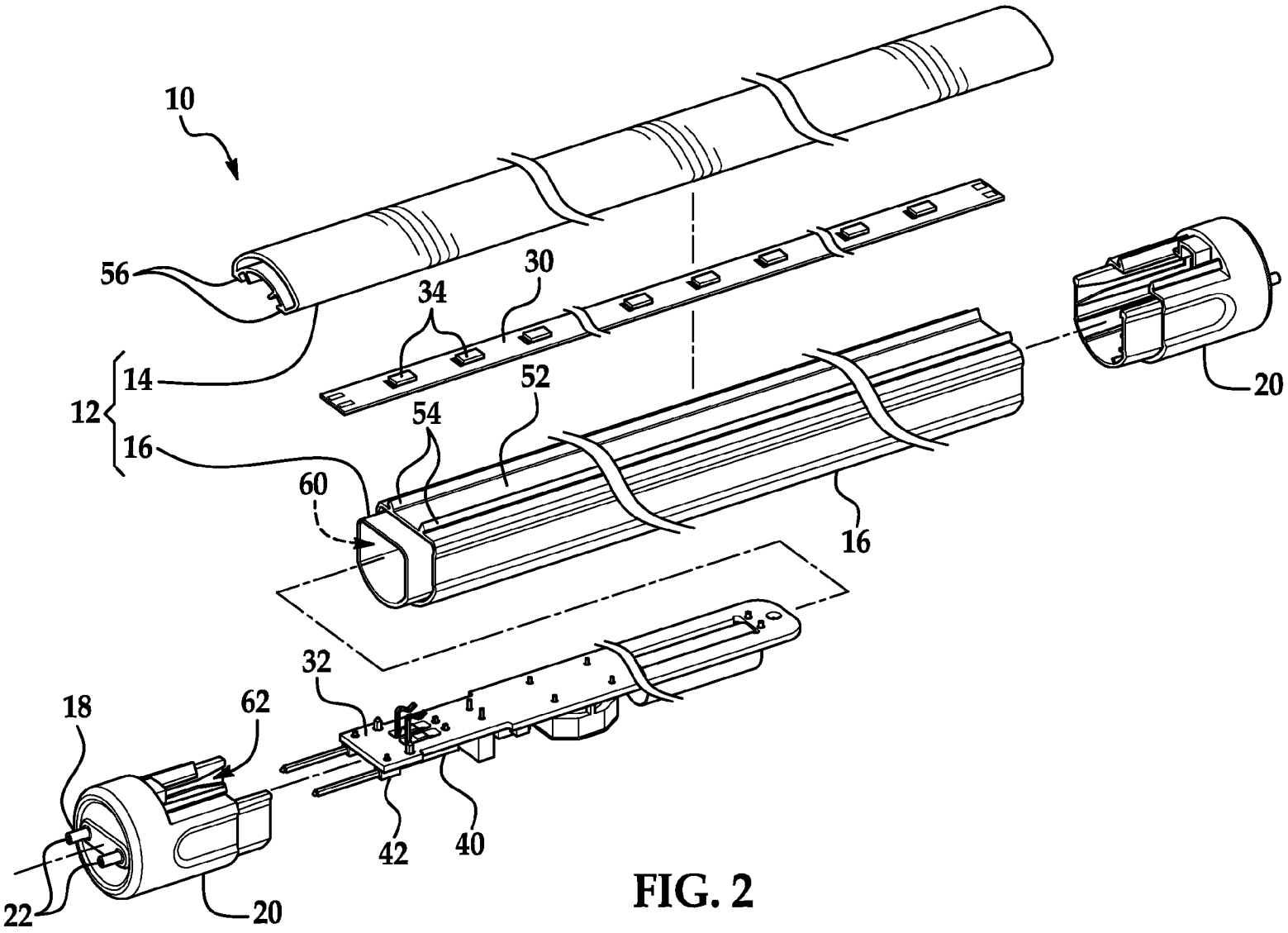
FIG. 2 is a perspective assembly view of the LED-based light showing a housing including a lower portion and a lens, an LED circuit board, a power supply circuit board and a pair of end caps.

An example of an LED-based light 10 for replacing a conventional light in a standard light fixture is illustrated in FIGS. 1 and 2. The LED-based light 10 includes a housing 12 and has a pair of end caps 20 positioned at the ends of the housing 12. An LED circuit board 30 including the LEDs 34 and a power supply circuit board 32 are arranged within the housing 12.

The housing 12 of the LED-based light 10 can generally define a single package sized for use in a standard fluorescent light fixture. In the illustrated example, the pair of end caps 20 is attached at opposing longitudinal ends of the housing 12 for physically connecting the LED-based light 10 to a light fixture. As shown, each end cap 20 carries an electrical connector 18 configured to physically connect to the light fixture. The electrical connectors 18 can be the sole physical connection between the LED-based light 10 and the light fixture. One example of a light fixture for the LED-based light 10 is a troffer designed to accept conventional fluorescent lights, such as T5, T8 or T12 fluorescent tube lights. These and other light fixtures for the LED-based light 10 can include one or more sockets adapted for physical engagement with the electrical connectors 18. Each of the illustrated electrical connectors 18 is a bi-pin connector including two pins 22. Bi-pin electrical connectors 18 are compatible with many fluorescent light fixtures and sockets, although other types of electrical connectors can be used, such as a single pin connector or a screw type connector.

The light fixture can connect to a power source, and at least one of the electrical connectors 18 can additionally electrically connect the LED-based light 10 to the light fixture to provide power to the LED-based light 10. In this example, each electrical connector 18 can include two pins 22, although two of the total four pins can be "dummy pins" that provide physical but not electrical connection to the light fixture. The light fixture can optionally include a ballast for electrically connecting between the power source and the LED-based light 10.

While the illustrated housing 12 is cylindrical, a housing having a square, triangular, polygonal, or other cross sectional shape can alternatively be used. Similarly, while the illustrated housing 12 is linear, housings having an alternative shape, e.g., a U-shape or a circular shape can alternatively be used. The LED-based light 10 can have any suitable length. For example, the LED-based light 10 may be approximately 48" long, and the housing 12 can have a 0.625", 1.0" or 1.5" diameter for engagement with a standard fluorescent light fixture.

The housing 12 can be formed by attaching multiple individual parts, not all of which need be light transmitting. For example, illustrated example of the housing 12 is formed in part by attaching a lens 14 at least partially defining the housing 12 to an opaque lower portion 16. The illustrated housing 12 has a generally bipartite configuration defining a first cavity 50 between the lower portion 16 and the lens 14 sized and shaped for housing the LED circuit board 30 and a second cavity 60 defined by the lower portion 16 sized and shaped for housing the power supply circuit board 32.

As shown, the lower portion 16 defines an LED mounting surface 52 for supporting the LED circuit board 30. The LED mounting surface 52 can be substantially flat, so as to support a flat underside of the LED circuit board 30 opposite the LEDs 34. After attachment of the lens 14 to the lower portion 16 during assembly of the LED-based light 10, the LED circuit board 30 is positioned within the first cavity 50 and adjacent the lens 14, such that the LEDs 34 of the LED circuit board 30 are oriented to illuminate the lens 14.

The illustrated lower portion 16 has a tubular construction to define the second cavity 60, although the lower portion 16 could be otherwise configured to define a cavity configured for housing the power supply circuit board 32. The LED-based light 10 can include features for supporting the power supply circuit board 32 within the second cavity 60. For example, as shown, an end cap 20 may include channels 62 configured to slidably receive outboard portions of an end 32*a* of the power supply circuit board 32. It will be understood that the channels 62 are provided as a non-limiting example and that the power supply circuit board 32 may be otherwise and/or additionally supported within the second cavity 60.

The lower portion 16 may be constructed from a thermally conductive material and configured as a heat sink to enhance dissipation of heat generated by the LEDs 34 during operation to an ambient environment surrounding the LED-based light 10. In the exemplary LED-based light 10, an LED mounting surface 52 of the lower portion 16 is thermally coupled to the LEDs 34 through the LED circuit board 30, and the remainder of the lower portion 16 defines a heat transfer path from the LED mounting surface 52 to the ambient environment.

The lower portion 16 and the lens 14 may each include complementary structures permitting for attachment of the lens 14 to the lower portion 16 to define the first cavity 50. For example, as shown, the lower portion 16 may include a pair of hooked projections 54 for retaining a corresponding pair of projections 56 of the lens 14. The projections 56 of the lens 14 can be slidably engaged with the hooked projections 54 of the lower portion 16, or can be snap fit to the hooked projections 54. The hooked projections 54 can be formed integrally with the lower portion 16 by, for example, extruding the lower portion 16 to include the hooked projections 54. Similarly, the projections 56 can be formed integrally with the lens 14 by, for example, extruding the lens 14 to include the projections 56. The hooked projections 54 and projections 56 can extend the longitudinal lengths of the lower portion 16 and the lens 14, respectively, although a number of discrete hooked projections 54 and/or projections 56 could be used to couple the lens 14 to the lower portion 16. Alternatively, the lower portion 16 could be otherwise configured for attachment with the lens 14. For example, the lens 14 could be clipped, adhered, snap- or friction-fit, screwed or otherwise attached to the lower portion 16.

Alternatively to the illustrated housing 12, the housing 12 can include a light transmitting tube at least partially defined by the lens 14. The lens 14 can be made from polycarbonate, acrylic, glass or other light transmitting material (i.e., the lens 14 can be transparent or translucent). The term "lens" as used herein means a light transmitting structure, and not necessarily a structure for concentrating or diverging light.

Although light fixtures for the LED-based light 10 may include structures and surfaces configured to distribute the light produced by fluorescent lights, these light fixture may not be equipped to effectively distribute the relatively more directional light produced by the LED-based light 10 across an exit plane of the fixture. In these light fixtures, the spacing between multiple LED-based lights 10 can create "hot spots" at locations corresponding to the positions of the LED-based lights 10 on production of light by the LEDs 34. In addition, because the LED-based light 10 is generally a more efficient source of light compared to a fluorescent light, it is contemplated that one or more of the total lights in a light fixture may be eliminated during a retrofit replacement of fluorescent lights with the LED-based lights 10. This in turn may accentuate the existence and appearance of hot spots.

According to one example implementation of the LED-based light 10, the lens 14 is configured with features for modifying and diffusively transmitting the light emanating from the LEDs 34 of the LED-based light 10. Although the description follows with general reference to the spatial aspects of the light transmitted from the lens 14, it will be understood that the lens 14 could be additionally configured to modify, for instance, the spectral aspects of the emanated light.

Figure 3:
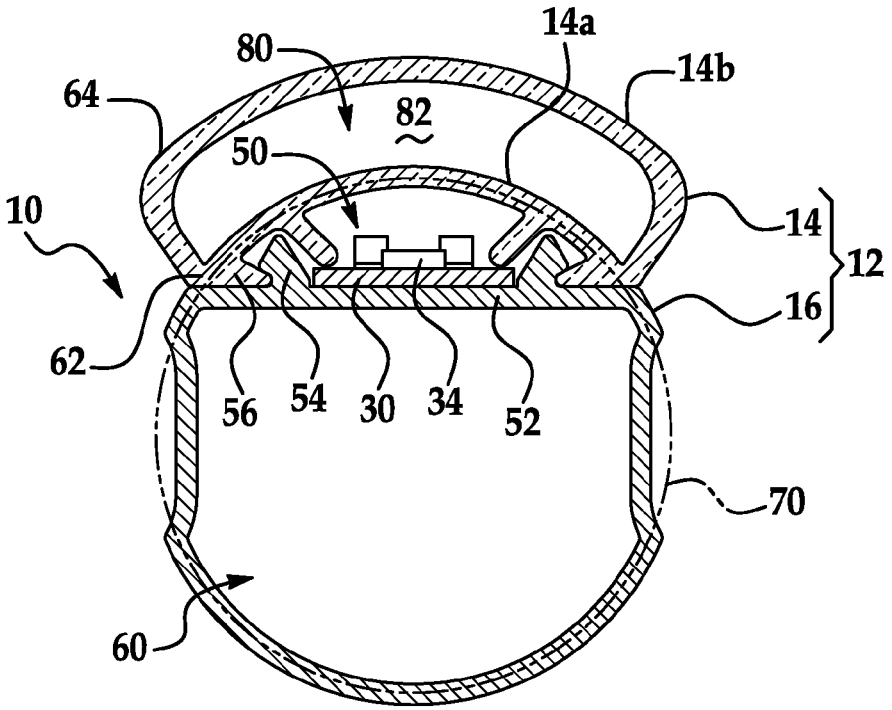
FIG. 3 is a cross section of the LED-based light taken at a position similar to the line A-A in FIG. 1 and illustrating an example of the structure of the lens.

An example of the structure of the lens 14 is discussed in greater detail with additional reference to FIG. 3. The illustrated lens 14 has a first, inner lens 14*a* and a second, outer lens 14*b*. In the illustrated LED-based light 10, the inner lens 14*a* generally spans the LED mounting surface 52 of the lower portion 16 of the housing 12 to enclose the LEDs 34 in conjunction with the end caps 20.

The outer lens 14*b* is arranged over, and generally spans, the inner lens 14*a*. As shown, both the outer lens 14*b* and the inner lens 14*a* are joined at common, opposing longitudinally extending edges 62 forming respective bases for the pair of hooked projections 54. With both the inner lens 14*a* and the outer lens 14*b* having commonly facing curved profiles between the opposing longitudinally extending edges 62, the inner lens 14*a* and the outer lens 14*b* together have a hollow, generally crescent shaped cross section.

The inner lens 14*a* and the outer lens 14*b* of the lens 14 can be formed integrally using an extrusion process, for example. Alternatively, the lower portion 16 of the housing 12, the inner lens 14*a* and/or the outer lens 14*b* can include features permitting for attachment of the outer lens 14*b* to the LED-based light 10 in a spaced relationship to the lower lens surface 14*a*.

The line 70 overlaying the cross section of the LED-based light 10 in FIG. 3 is indicative of the cross sectional profile of a fluorescent light that the LED-based light 10 is designed to replace. In accordance with typical fluorescent lights, the line 70 is generally circular and may have a 0.625", 1.0" or 1.5" diameter, for example. As shown, the lower portion 16 of the housing 12 and the inner lens 14*a* each have cross sectional profiles with radially outer portions that substantially fall along the line 70.

In the illustrated LED-based light 10, substantially the entire outer lens 14*b* is spaced radially outward from the inner lens 14*a*, further from the LEDs 34 than the inner lens 14*a*. It follows that, although a portion of the outer lens 14*b*, such as the opposing longitudinally extending edges 62, may generally fall on or near the line 70 indicating the cross sectional profile of a fluorescent light that the LED-based light 10 is designed to replace, substantially all of the radially outer portion of the cross sectional profile of the outer lens 14*b* falls outside of the line 70. This arrangement may, among other things, provide an advantage with respect to the diffusion of the light emanating from the LEDs 34.

In general, in diffusing the light emanating from a light source with an angular spread, such as the LEDs 34, a lens can effectively utilize the extent to which the light emanating from the LEDs 34 is already spread over space. Thus, for LEDs 34 with a given spread, the effectiveness of a lens in diffusing the light emanating from the LEDs 34 of the LED-based light 10 is a product of, among other things, the proximity of the lens to the LEDs 34. The radially outward spacing of the outer lens 14*b* in the illustrated lens 14 therefore allows for greater diffusion of the light emanating from the LEDs 34, as compared, for example, to the inner lens 14*a* in the illustrated LED-based light 10 or lenses in other LED-based lights that similarly fall along the cross sectional profile of a fluorescent light.

The outer lens 14*b* can be also be sized and shaped such that, in addition to diffusing the light passed by the inner lens 14*a*, the outer lens 14*b* transmits the light emanating from the LEDs 34 with a greater angular distribution than achieved with a similar LED-based light 10 having a lens 14 without the outer lens 14*b*.

For the illustrated LED-based light 10, the inner lens 14*a* is configured to pass the light emanated from the LEDs 34 into a space 80 defined between the inner lens 14*a* and the outer lens 14*b*, and the outer lens 14*b* is configured to diffusively transmit the light passed by the inner lens 14*a* to into the environment surrounding the LED-based light 10. On production of light by the LEDs 34 of the LED-based light 10, reflection between the inner lens 14*a* and the outer lens 14*b* causes the space 80 to act as a mixing chamber for the light emanated from the LEDs 34 prior to transmission from the outer lens 14*b*. With the space 80 acts as a mixing chamber for the light emanated from the LEDs 34 in this manner, the light is transmitted from all or substantially all of the outer lens 14*b*, such that the outer lens 14*b* as a whole acts as the effective source of light for the LED-based light 10 for purposes of light distribution.

As explained above, the lower portion 16 of the housing 12 and the lower lens surface 14*a* each have cross sectional profiles with radially outer portions that substantially fall along the line 70 indicating the cross sectional profile of a fluorescent light. Moreover, for the illustrated LED-based light 10, these radial outer portions together substantially fall along the full circumference of the line 70. In this arrangement, the radial outer portion of the inner lens 14*a* generally falls along a minor arc of the line 70, with the radial outer portion of the lower portion 16 of the housing 12 falling along a major arc of the line 70.

The LEDs 34 generally face the lens 14, with the lens 14, in cross section, being centered normal to the LEDs 34. In operation, the LEDs 34 of the LED-based light 10 may be configured to emanate light generally in line with the LEDs 34 with a radial distribution centered normal to the LEDs 34. The light emanating from the LEDs 34 may, for instance, be distributed to occupy an approximately 100° to 120° spread from normal to the LEDs 34.

Figure 4:
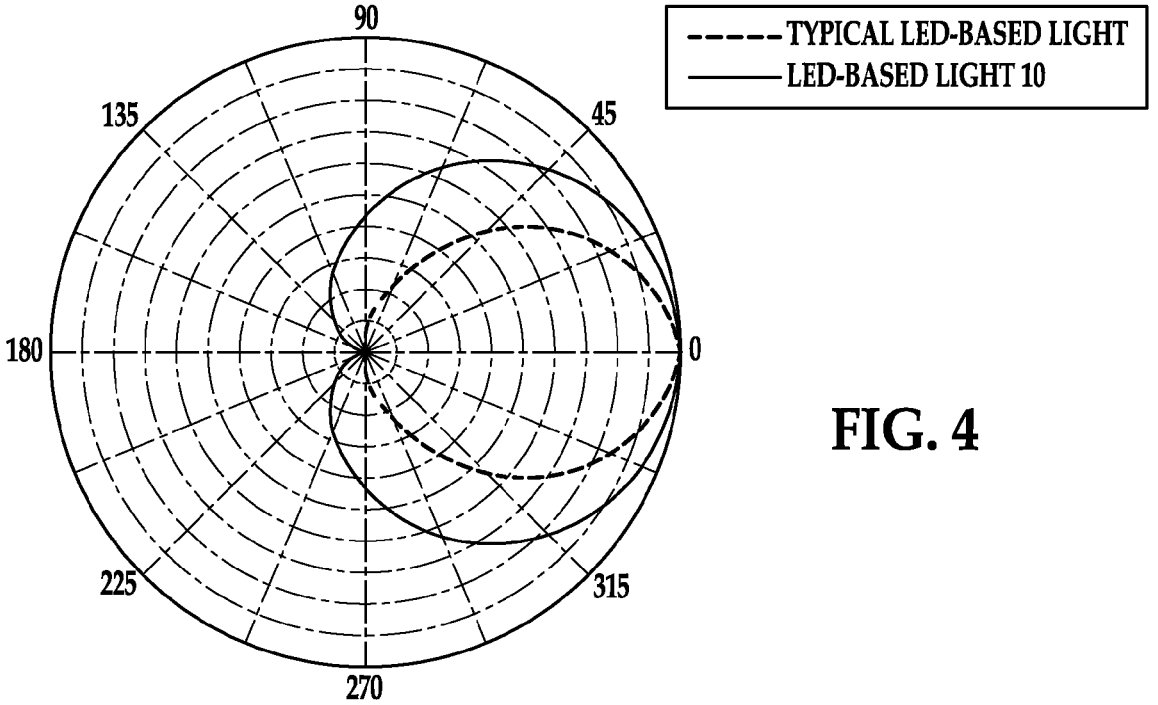
FIG. 4 is an example of a polar light distribution curve for the LED-based light, shown with reference to the polar light distribution curve for a typical LED-based light.

Absent the outer lens 14*b*, in which case the inner lens 14*a* as a whole would act as the effective source of light for the LED-based light 10, the LED-based light 10 is somewhat limited in its ability to distribute the light emanating from the LEDs 34 in a direction opposite the lens 14. Specifically, with the radial outer portion of the inner lens 14*a* generally falling along a minor arc of the line 70, much if not all of the light transmitted from the inner lens 14*a* at or proximate to the junction between the lens 14 and the lower portion 16 of the housing 12 (e.g., for the illustrated LED-based light 10, at the opposing longitudinally extending edges 62 of the lens 14) is blocked by the non-light transmitting lower portion 16 from being distributed in a direction opposite the lens 14. An example of a resulting light distribution for a typical LED-based light with this general configuration is shown in FIG. 4. As shown, for the typical LED-based light, little if any of the light emanating from the LEDs 34 is distributed in a direction opposite the lens 14. That is, the light emanating from the LEDs 34 is generally distributed with an angular distribution of 180° or less from normal to the LEDs 34.

In the illustrated example of the LED-based light 10 including the lens 14 having the outer lens 14*b*, with the outer lens 14*b* as a whole acting as the effective source of light for the LED-based light 10 for purposes of light distribution, the light emanating from the LEDs 34 may be distributed in a direction opposite the lens 14.

In particular, at least a portion of the outer lens 14*b* in the LED-based light 10 projects beyond the junction between the lens 14 and the lower portion 16 of the housing 12 (e.g., for the illustrated LED-based light 10, at the opposing longitudinally extending edges 62 of the lens 14). Thus, at least some of the light transmitted from these portions of the outer lens 14*b* is not blocked by the non-light transmitting lower portion 16 from being distributed in a direction opposite the lens 14. In the illustrated example of the LED-based light 10, for example, the outer lens 14*b* includes bulges 64 at the opposing longitudinally extending edges 62, which project beyond the lower portion 16 of the housing 12. Although the bulges 64 are given as one non-limiting example, it will be understood that in other examples of the LED-based light 10 the outer lens 14*b* may include other structures that project beyond the lower portion 16 of the housing 12.

An example of a resulting light distribution for the illustrated example of the LED-based light 10 with the illustrated configuration is shown in FIG. 4. As shown, for the LED-based light 10, at least a portion of the light emanating from the LEDs 34 is distributed in a direction opposite the lens 14. Therefore, as shown, the light emanating from the LEDs 34 is generally distributed with an angular distribution of 180° or more from normal to the LEDs 34.

Figure 5:
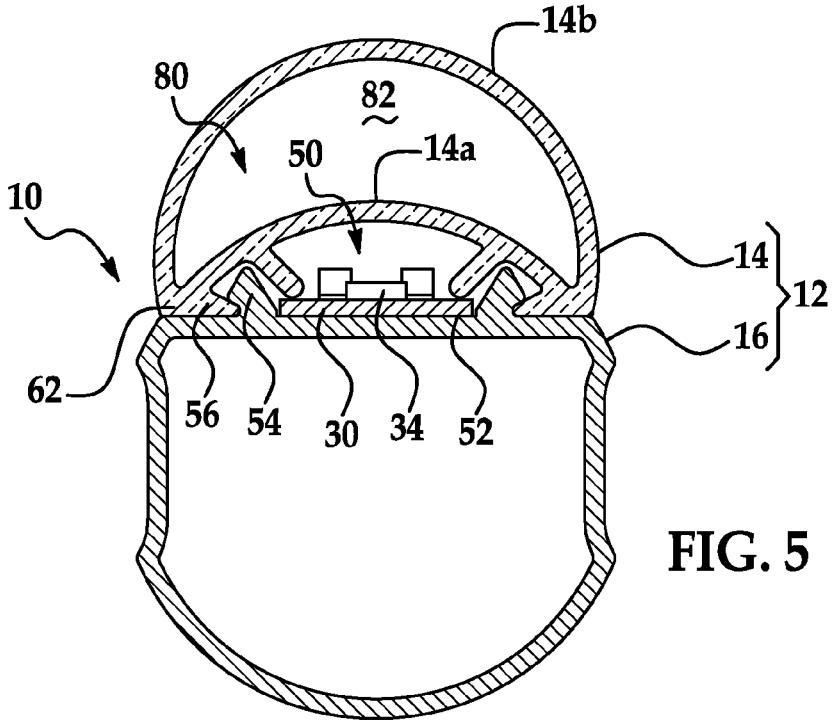
FIGS. 5 and 6 are additional cross sections of the LED-based light taken at positions similar to the line A-A in FIG. 1 and illustrating alternative examples of the structure of the lens.
Figure 6:
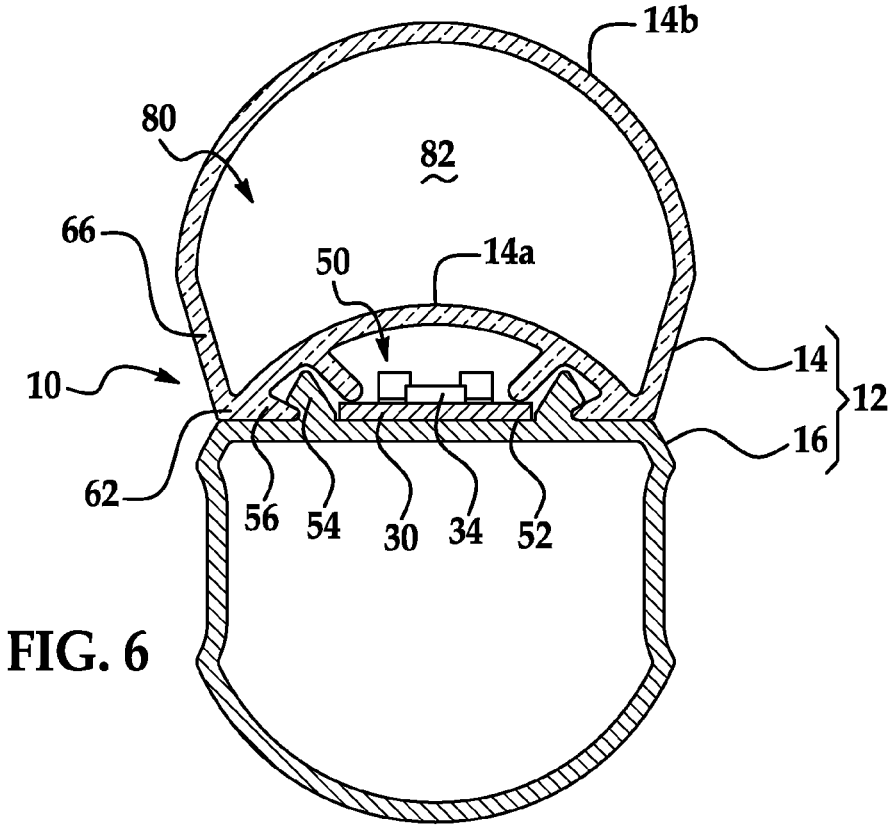

Alternative examples of the structure of the lens 14 are shown in FIGS. 5 and 6. In these examples, the configuration of the inner lens 14*a* is substantially as described above. The outer lens 14*b* in these examples is also similarly arranged over, and generally spans, the inner lens 14*a*, and as in the example of FIG. 3, both the outer lens 14*b* and the inner lens 14*a* are joined at common, opposing longitudinally extending edges 62 forming respective bases for the pair of hooked projections 54. In addition, in these examples, both the inner lens 14*a* and the outer lens 14*b* have commonly facing, at least partially curved profiles between the opposing longitudinally extending edges 62, such that the inner lens 14*a* and the outer lens 14*b* together have a hollow, generally crescent shaped cross section.

In FIG. 5, the outer lens 14*b* is generally semi-circular. In addition, the outer lens 14*b* is even further spaced from the inner lens 14*a* as compared to the example of FIG. 3, allowing for greater diffusion of the light emanating from the LEDs 34.

In FIG. 6, the outer lens 14*b* is similarly even further spaced from the inner lens 14*a* as compared to the example of FIG. 3, allowing for greater diffusion of the light emanating from the LEDs 34. In addition, at least a portion of the outer lens 14*b* in the LED-based light 10 projects beyond the junction between the lens 14 and the lower portion 16 of the housing 12 (e.g., for the illustrated LED-based light 10, at the opposing longitudinally extending edges 62 of the lens 14). In this example of the LED-based light 10, the outer lens 14*b* includes opposing upright side walls 66 that are angled outward from the opposing longitudinally extending edges 62 to project beyond the lower portion 16 of the housing 12, such that the light emanating from the LEDs 34 is generally distributed with an angular distribution of 180° or more from normal to the LEDs 34.

The lens 14 can be manufactured to include light diffusing structures, such as ridges, dots, bumps, dimples or other uneven surfaces formed on an interior or exterior of the outer lens 14*b*. The light diffusing structures can be formed integrally with the outer lens 14*b*, for example, by molding or extruding, or the structures can be formed in a separate manufacturing step such as surface roughening. Alternatively, the material from which the outer lens 14*b* is formed can include light refracting particles. For example, the outer lens 14*b* can be made from a composite, such as polycarbonate, with particles of a light refracting material interspersed in the polycarbonate.

The outer lens 14*b* may be configured to transmit the light emanating from the LEDs 34 uniformly. Alternatively, in some implementations, outer lens 14*b* may have one or more portions that include an opaque and/or reflective material to block those portions from transmitting the light emanating from the LEDs 34. For example, a central reflection strip (e.g., one made of a reflective material such as aluminized mylar) may be applied to the length of an interior central portion of the outer lens 14*b* to prevent light from being emitted directly downwards from the outer lens 14*b*, thereby making the LED-based light 10 an indirect light source. In other examples, one or more portions of the outer lens 14*b* can be provided with a different diffusing texture, an optical control film such as multi-layer dielectric reflector, or other features that change the localized appearance of the light transmitted from the outer lens 14*b* at those portions. Similarly, one or more variable internal reflectors may be included on the outer lens 14*b* or in the space 80 between the inner lens 14*a* and the outer lens 14*b* to transmit a variety of different patterns of light from the outer lens 14*b*. In addition to or as an alternative to the foregoing features, the space 80 between the inner 14*a* and the outer lens 14*b* can be filled with silicone or other light transmitting material to allow for further manipulation of the transmission of light from the outer lens 14*b*. The light transmitting material may, for example, be further configured with thermal properties to aid in heat transfer from the lens 14. In these or other examples of the lens 14, the space 80 can be closed off using plugs 82. The plugs 82 could be formed integrally with the lens 14, for example, or could be formed separately from the lens 14 and applied in a separate manufacturing step.

The lens 14 can optionally be manufactured to include similar light diffusing structures on an interior or exterior of the inner lens 14*a*. However, in one example configuration of the lens 14, the inner lens 14*a* can be substantially transparent and configured simply to pass the light emanated from the LEDs 34 into the space 80 formed between the inner lens 14*a* and the outer lens 14*b*. In this example configuration, any efficiency losses that would arise by diffusing the light emanated from the LEDs 34 as it passes through the inner lens 14*a* are avoided. It will be understood that in this configuration, for the illustrated LED-based light 10, the inner lens 14*a* may still serve the function of enclosing the LEDs 34 in accordance with regulatory, design or other criteria.

The LED-based light 10 can include other features for distributing light produced by the LEDs 34. For example, the lens 14 can be manufactured with structures at the inner lens 14*a* and/or the outer lens 14*b* to collimate light produced by the LEDs 34. The light collimating structures can be formed integrally with the lens 14, for example, or can be formed in a separate manufacturing step. In addition to or as an alternative to manufacturing the lens 14 to include light collimating structures, a light collimating film can be applied to the inner lens 14*a* and/or the outer lens 14*b*.

In yet other embodiments, the LEDs 34 can be over molded or otherwise encapsulated with light transmitting material configured to distribute light produced by the LEDs 34. For example, the light transmitting material can be configured to diffuse, refract, collimate and/or otherwise distribute the light produced by the LEDs 34. The over molded LEDs 34 can be used alone to achieve a desired light distribution for the LED-based light 10, or can be implemented in combination with the lens 14 and/or films described above.

The above described or other light distributing features can be implemented uniformly or non-uniformly along a length and/or circumference of the LED-based light 10. These features are provided as non-limiting examples, and in other embodiments, the LED-based light 10 may not include any light distributing features.

The LED circuit board 30 can include at least one LED 34, a plurality of series-connected or parallel-connected LEDs 34, an array of LEDs 34 or any other arrangement of LEDs 34. Each of the illustrated LEDs 34 can include a single diode or multiple diodes, such as a package of diodes producing light that appears to an ordinary observer as coming from a single source. The LEDs 34 can be surface-mount devices of a type available from Nichia, although other types of LEDs can alternatively be used. For example, the LED-based light 10 can include high-brightness semiconductor LEDs, organic light emitting diodes (OLEDs), semiconductor dies that produce light in response to current, light emitting polymers, electro-luminescent strips (EL) or the like. The LEDs 34 can emit white light. However, LEDs that emit blue light, ultraviolet light or other wavelengths of light can be used in place of or in combination with white light emitting LEDs 34.

The orientation, number and spacing of the LEDs 34 can be a function of a length of the LED-based light 10, a desired lumen output of the LED-based light 10, the wattage of the LEDs 34, a desired light distribution for the LED-based light 10 and/or the viewing angle of the LEDs 34.

The LEDs 34 can be fixedly or variably oriented in the LED-based light 10 for facing or partially facing an environment to be illuminated when the LED-based light 10 is installed in a light fixture. Alternatively, the LEDs 34 can be oriented to partially or fully face away from the environment to be illuminated. In this alternative example, the LED-based light 10 and/or a light fixture for the LED-based light 10 may include features for reflecting or otherwise redirecting the light produced by the LEDs into the environment to be illuminated.

For a 48" LED-based light 10, the number of LEDs 34 may vary from about thirty to three hundred such that the LED-based light 10 outputs between 1,500 and 3,000 lumens.

However, a different number of LEDs 34 can alternatively be used, and the LED-based light 10 can output any other amount of lumens.

The LEDs 34 can be arranged in a single longitudinally extending row along a central portion of the LED circuit board 30 as shown, or can be arranged in a plurality of rows or arranged in groups. The LEDs 34 can be spaced along the LED circuit board 30 and arranged on the LED circuit board 30 to substantially fill a space along a length of the lens 14 between end caps 20 positioned at opposing longitudinal ends of the housing 12. The spacing of the LEDs 34 can be determined based on, for example, the light distribution of each LED 34 and the number of LEDs 34. The spacing of the LEDs 34 can be chosen so that light output by the LEDs 34 is uniform or non-uniform along a length of the lens 14. In one implementation, one or more additional LEDs 34 can be located at one or both ends of the LED-based light 10 so that an intensity of light output at the lens 14 is relatively greater at the one or more ends of the LED-based light 10. Alternatively, or in addition to spacing the LEDs 34 as described above, the LEDs 34 nearer one or both ends of the LED-based light 10 can be configured to output relatively more light than the other LEDs 34. For instance, LEDs 34 nearer one or both ends of the LED-based light 10 can have a higher light output capacity and/or can be provided with more power during operation.

The power supply circuit board 32 is positioned within the housing 12 adjacent the electrical connector 18 and has power supply circuitry configured to condition an input power received from, for example, the light fixture through the electrical connector 18, to a power usable by and suitable for the LEDs 34. In some implementations, the power supply circuit board 32 can include one or more of an inrush protection circuit, a surge suppressor circuit, a noise filter circuit, a rectifier circuit, a main filter circuit, a current regulator circuit and a shunt voltage regulator circuit. The power supply circuit board 32 can be suitably designed to receive a wide range of currents and/or voltages from a power source and convert them to a power usable by the LEDs 34.

The LED-based light 10 may require a number of electrical connections to convey power between the various illustrated spatially distributed electrical assemblies included in the LED-based light 10, such as the LED circuit board 30, the power supply circuit board 32 and the electrical connector 18. These connections can be made using a circuit connector header 40 and a pin connector header 42, as shown in FIG. 3. In particular, when the LED-based light 10 is assembled, the circuit connector header 40 may be arranged to electrically couple the LED circuit board 30 to the power supply circuit board 32, and the pin connector header 42 may be arranged to electrically couple the power supply circuit board 32 to the pins 22 of an end cap 20.

As shown, the LED circuit board 30 and the power supply circuit board 32 are vertically opposed and spaced with respect to one another within the housing 12. The LED circuit board 30 and the power supply circuit board 32 can extend a length or a partial length of the housing 12, and the LED circuit board 30 can have a length different from a length of the power supply circuit board 32. For example, the LED circuit board 30 can generally extend a substantial length of the housing 12, and the power supply circuit board 32 can extend a partial length of the housing. However, it will be understood that the LED circuit board 30 and/or the power supply circuit board 32 could be alternatively arranged within the housing 12, and that the LED circuit board 30 and the power supply circuit board 32 could be alternatively spaced and/or sized with respect to one another.

The LED circuit board 30 and the power supply circuit board 32 are illustrated as elongate printed circuit boards. Multiple circuit board sections can be joined by bridge connectors to create the LED circuit board 30 and/or power supply circuit board 32. Also, other types of circuit boards may be used, such as a metal core circuit board. Further, the components of the LED circuit board 30 and the power supply circuit board 32 could be in a single circuit board or more than two circuit boards.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An LED-based replacement light for a fluorescent light, comprising:

a plurality of LEDs;

an elongate housing for the LEDs, the housing defined at least in part by an inner lens having a cross sectional profile that follows a portion of a cross sectional profile of a fluorescent light that the LED-based light is designed to replace, with an outer lens extending beyond the cross sectional profile of the fluorescent light and forming a space between the inner lens and the outer lens; and at least one connector arranged at an end of the housing, the connector configured for engagement with a socket of a fluorescent light fixture.

2. The LED-based light of claim 1, wherein the inner lens at least partially encloses the plurality of LEDs and is configured to pass light that is emanated from the plurality of LEDs, and the outer lens is configured to diffusively transmit the light passed by the inner lens.

3. The LED-based light of claim 1, wherein both the inner lens and the outer lens have an at least partially curved cross sectional profile, with the inner lens and the outer lens sharing opposing longitudinally extending edges.

4. The LED-based light of claim 1, wherein the space between the inner lens and the outer lens is at least partially filled with a light transmitting material.

5. The LED-based light of claim 1, wherein the housing is further defined at least in part by an opaque lower portion, with the inner lens being attached to the lower portion such that an elongate junction is formed between the inner lens and the lower portion at the cross sectional profile of the housing, and wherein the outer lens at least partially projects beyond the junction.

6. The LED-based light of claim 5, wherein the outer lens that at least partially projects beyond the junction is a bulge.

7. The LED-based light of claim 5, wherein the outer lens is an angled side wall.

8. The LED-based light of claim 5, wherein at least a portion of the lower portion falls along the cross sectional profile of the fluorescent light.

9. The LED-based light of claim 1, wherein the plurality of LEDs are configured to emanate light at a first angle less than 180 degrees, and the inner lens and outer lens are configured to transmit light that is emanated from the LEDs at a second angle greater than 180 degrees.

10. An LED-based replacement light for a fluorescent light, comprising:

a plurality of LEDs;

an elongate housing for the LEDs, the housing at least partially defined by an opaque lower portion, an inner lens and an outer lens spaced apart from the inner lens, wherein the cross sectional profiles of the lower portion and the inner lens at least partially fall along a cross sectional profile of a fluorescent light that the LED-based light is designed to replace, with the outer lens extending beyond the cross sectional profile of the fluorescent light; and at least one connector arranged at an end of the housing, the connector configured for engagement with a socket of a fluorescent light fixture.

11. The LED-based light of claim 10, wherein radially outer portions of the cross sectional profiles of the lower portion and the inner lens substantially fall along the cross sectional profile of the fluorescent light.

12. The LED-based light of claim 10, wherein a radially outer portion of a cross sectional profile of the inner lens substantially falls along only a minor arc of the cross sectional profile of the fluorescent light, both the inner lens and the outer lens share opposing longitudinally extending edges located at opposing elongate junctions formed at the lower portion, and the outer lens at least partially projects beyond each of the junctions.

13. The LED-based light of claim 12, wherein a portion of the outer lens projects beyond each of the junctions as a bulge.

14. The LED-based light of claim 12, wherein a portion of the outer lens projects beyond each of the junctions as an angled side wall.

15. The LED-based light of claim 12, wherein both the inner lens and the outer lens have an at least partially curved cross sectional profile.

16. The LED-based light of claim 10, wherein the inner lens at least partially encloses the plurality of LEDs and is configured to substantially pass light that is emanated from the plurality of LEDs, and the outer lens is configured to diffusively transmit the light passed by the inner lens at an angle greater than 180 degrees.

17. An LED-based light, comprising:

a plurality of LEDs;

an elongate housing for the LEDs, the housing at least partially defined by an inner lens and an outer lens spaced from the inner lens, wherein both the inner lens and the outer lens have an at least partially curved cross sectional profile facing in a common direction away from the plurality of LEDs the housing having a circular cross-section with the inner lens forming a portion of the circumference of the circular cross section; and at least one connector arranged at an end of the housing, the connector configured for engagement with a socket of a fluorescent light fixture.

18. The LED-based light of claim 17, wherein the outer lens overlays the inner lens and is attached to the inner lens at opposed longitudinally extending edges, with the inner lens and the outer lens together forming a closed and generally crescent shaped cross sectional profile.

* * * * *